US009496615B2

(12) United States Patent
Hsu et al.

(10) Patent No.: US 9,496,615 B2
(45) Date of Patent: Nov. 15, 2016

(54) MULTIBAND ANTENNA AND MULTIBAND ANTENNA CONFIGURATION METHOD

(71) Applicant: Wistron NeWeb Corporation, Hsinchu (TW)

(72) Inventors: Chieh-Sheng Hsu, Hsinchu (TW); Cheng-Geng Jan, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 346 days.

(21) Appl. No.: 14/451,376

(22) Filed: Aug. 4, 2014

(65) Prior Publication Data

US 2015/0263426 A1 Sep. 17, 2015

(30) Foreign Application Priority Data

Mar. 17, 2014 (TW) ..... 103109977 A

(51) Int. Cl.

| | |
|---|---|
| ***H01Q 1/12*** | (2006.01) |
| ***H01Q 5/378*** | (2015.01) |
| ***H01Q 15/00*** | (2006.01) |
| ***H01Q 15/14*** | (2006.01) |
| *H01Q 19/10* | (2006.01) |
| *H01Q 1/22* | (2006.01) |

(52) U.S. Cl.

CPC ..... *H01Q 5/378* (2015.01); *H01Q 15/008* (2013.01); *H01Q 15/14* (2013.01); *H01Q 1/2266* (2013.01); *H01Q 19/10* (2013.01)

(58) Field of Classification Search

CPC ..... H01Q 115/14; H01Q 15/008; H01Q 1/2266; H01Q 5/378; H01Q 19/10

See application file for complete search history.

(56) References Cited

U.S. PATENT DOCUMENTS

| | | | | |
|---|---|---|---|---|
| 8,451,189 | B1 | 5/2013 | Fluhler | |
| 8,604,992 | B2 * | 12/2013 | Kobayashi | G06K 7/10316 343/700 MS |
| 9,431,709 | B2 * | 8/2016 | Mckinzie, III | H01Q 9/0407 |

* cited by examiner

*Primary Examiner* — Khai M Nguyen

(74) *Attorney, Agent, or Firm* — Winston Hsu; Scott Margo

(57) ABSTRACT

A multiband antenna configuration method for configuring a multiband antenna to transmit and receive radio signals of a plurality of frequency bands includes determining a distance between a magnetic conductor reflector and a first radiation portion, calculating a first and second reflection phase value at the first and second center frequency of a first and second frequency band according to a configuration requirement corresponding to the distance, determining a length and width of the multiband antenna, adjusting materials and geometric features of the magnetic conductor reflector to change a curve representing relationship between reflection phases of the magnetic conductor reflector and frequencies and to make the first reflection phase corresponding to the first center frequency and the second reflection phase corresponding to the second center frequency equal to a first reflection phase value and second reflection phase value, and determining the materials and geometric features according to the curve.

14 Claims, 25 Drawing Sheets

Radiation portion 510 :

| H-cut | Peak gain | 3dB BW | F/B ratio | Co/Cx |
|---|---|---|---|---|
| 791(MHz) | 5.72 dBi | 96 deg | 12.4 dB | 29.5 dB |
| 821(MHz) | 6.01 dBi | 100 deg | 17.9 dB | 29.0 dB |
| 832(MHz) | 5.95 dBi | 102 deg | 21.0 dB | 28.7 dB |
| 862(MHz) | 5.50 dBi | 106 deg | 24.3 dB | 27.1 dB |
| 2500(MHz) | 10.9 dBi | 41 deg | 9.2 dB | 21.7 dB |
| 2570(MHz) | 11.1 dBi | 41 deg | 10.6 dB | 21.4 dB |
| 2620(MHz) | 10.9 dBi | 40 deg | 11.0 dB | 21.5 dB |
| 2690(MHz) | 10.5 dBi | 39 deg | 10.5 dB | 21.9 dB |

| V-cut | Peak gain | 3dB BW | F/B ratio | Co/Cx |
|---|---|---|---|---|
| 791(MHz) | 5.72 dBi | 96 deg | 12.4 dB | 28.6 dB |
| 821(MHz) | 6.01 dBi | 100 deg | 17.9 dB | 28.0 dB |
| 832(MHz) | 5.95 dBi | 102 deg | 21.0 dB | 27.8 dB |
| 862(MHz) | 5.50 dBi | 106 deg | 24.3 dB | 26.7 dB |
| 2500(MHz) | 10.9 dBi | 41 deg | 9.2 dB | 23.3 dB |
| 2570(MHz) | 11.1 dBi | 41 deg | 10.6 dB | 22.9 dB |
| 2620(MHz) | 10.9 dBi | 41 deg | 11.0 dB | 22.9 dB |
| 2690(MHz) | 10.5 dBi | 40 deg | 10.5 dB | 23.1 dB |

Radiation portion 520 :

| H-cut | Peak gain | 3dB BW | F/B ratio | Co/Cx |
|---|---|---|---|---|
| 791(MHz) | 5.81 dBi | 96 deg | 12.1 dB | 29.7 dB |
| 821(MHz) | 6.16 dBi | 99 deg | 16.6 dB | 29.2 dB |
| 832(MHz) | 6.13 dBi | 100 deg | 18.9 dB | 28.9 dB |
| 862(MHz) | 5.81 dBi | 104 deg | 25.9 dB | 27.7 dB |
| 2500(MHz) | 10.5 dBi | 42 deg | 10.3 dB | 21.1 dB |
| 2570(MHz) | 10.6 dBi | 42 deg | 11.9 dB | 19.9 dB |
| 2620(MHz) | 10.5 dBi | 42 deg | 12.2 dB | 19.2 dB |
| 2690(MHz) | 10.1 dBi | 41 deg | 11.4 dB | 18.3 dB |

| V-cut | Peak gain | 3dB BW | F/B ratio | Co/Cx |
|---|---|---|---|---|
| 791(MHz) | 5.81 dBi | 96 deg | 12.1 dB | 29.2 dB |
| 821(MHz) | 6.16 dBi | 99 deg | 16.6 dB | 28.5 dB |
| 832(MHz) | 6.13 dBi | 100 deg | 18.9 dB | 28.2 dB |
| 862(MHz) | 5.81 dBi | 104 deg | 25.9 dB | 27.3 dB |
| 2500(MHz) | 10.5 dBi | 42 deg | 10.3 dB | 21.5 dB |
| 2570(MHz) | 10.6 dBi | 42 deg | 11.9 dB | 20.1 dB |
| 2620(MHz) | 10.5 dBi | 42 deg | 12.2 dB | 19.3 dB |
| 2690(MHz) | 10.1 dBi | 41 deg | 11.4 dB | 18.3 dB |

FIG. 4D

Radiation portion 510 :

| H-cut | Peak gain | 3dB BW | F/B ratio | Co/Cx |
|---|---|---|---|---|
| 791(MHz) | 5.29 dBi | 93 deg | 7.5 dB | 29.7 dB |
| 821(MHz) | 6.17 dBi | 97 deg | 12.0 dB | 28.9 dB |
| 832(MHz) | 6.16 dBi | 99 deg | 14.5 dB | 28.0 dB |
| 862(MHz) | 5.73 dBi | 104 deg | 27.0 dB | 24.4 dB |
| 2500(MHz) | 10.6 dBi | 44 deg | 8.3 dB | 18.2 dB |
| 2570(MHz) | 10.5 dBi | 43 deg | 9.9 dB | 17.3 dB |
| 2620(MHz) | 10.1 dBi | 43 deg | 10.4 dB | 16.9 dB |
| 2690(MHz) | 9.37 dBi | 42 deg | 9.9 dB | 16.7 dB |

| V-cut | Peak gain | 3dB BW | F/B ratio | Co/Cx |
|---|---|---|---|---|
| 791(MHz) | 5.29 dBi | 93 deg | 7.5 dB | 29.4 dB |
| 821(MHz) | 6.17 dBi | 97 deg | 12.0 dB | 28.0 dB |
| 832(MHz) | 6.16 dBi | 99 deg | 14.5 dB | 27.6 dB |
| 862(MHz) | 5.73 dBi | 103 deg | 26.9 dB | 19.6 dB |
| 2500(MHz) | 10.6 dBi | 43 deg | 8.3 dB | 19.7 dB |
| 2570(MHz) | 10.5 dBi | 42 deg | 9.9 dB | 19.9 dB |
| 2620(MHz) | 10.1 dBi | 42 deg | 10.4 dB | 19.8 dB |
| 2690(MHz) | 9.37 dBi | 40 deg | 9.9 dB | 20.0 dB |

Radiation portion 520 :

| H-cut | Peak gain | 3dB BW | F/B ratio | Co/Cx |
|---|---|---|---|---|
| 791(MHz) | 5.01 dBi | 92 deg | 7.0 dB | 29.9 dB |
| 821(MHz) | 6.16 dBi | 95 deg | 10.7 dB | 29.3 dB |
| 832(MHz) | 6.27 dBi | 97 deg | 12.5 dB | 29.0 dB |
| 862(MHz) | 6.00 dBi | 102 deg | 20.1 dB | 27.6 dB |
| 2500(MHz) | 9.94 dBi | 44 deg | 8.9 dB | 19.2 dB |
| 2570(MHz) | 10.2 dBi | 44 deg | 11.2 dB | 18.7 dB |
| 2620(MHz) | 10.0 dBi | 44 deg | 12.0 dB | 18.1 dB |
| 2690(MHz) | 9.50 dBi | 43 deg | 11.6 dB | 17.3 dB |

| V-cut | Peak gain | 3dB BW | F/B ratio | Co/Cx |
|---|---|---|---|---|
| 791(MHz) | 5.01 dBi | 92 deg | 7.0 dB | 31.3 dB |
| 821(MHz) | 6.16 dBi | 96 deg | 10.7 dB | 30.1 dB |
| 832(MHz) | 6.27 dBi | 97 deg | 12.5 dB | 29.6 dB |
| 862(MHz) | 6.00 dBi | 102 deg | 20.1 dB | 28.2 dB |
| 2500(MHz) | 9.94 dBi | 44 deg | 8.9 dB | 19.2 dB |
| 2570(MHz) | 10.2 dBi | 44 deg | 11.2 dB | 19.1 dB |
| 2620(MHz) | 10.0 dBi | 44 deg | 12.0 dB | 18.4 dB |
| 2690(MHz) | 9.50 dBi | 43 deg | 11.6 dB | 17.5 dB |

FIG. 5D

MULTIBAND ANTENNA AND MULTIBAND ANTENNA CONFIGURATION METHOD

BACKGROUND OF THE INVENTION

1. Field of the Invention

The present invention relates to a multiband antenna and a multiband antenna configuration method, and more particularly, to a multiband antenna and a multiband antenna configuration method which cover a plurality of frequency bands, provide high gain, have boarder bandwidth, improve isolation, and effectively reduce antenna dimensions.

2. Description of the Prior Art

Electronic products with wireless communication functionalities, e.g. notebook computers, personal digital assistants, etc., utilize antennas to emit and receive radio waves, to transmit or exchange radio signals, so as to access a wireless communication network. Therefore, to facilitate a user's access to the wireless communication network, an ideal antenna should maximize its bandwidth within a permitted range, while minimizing physical dimensions to accommodate the trend for smaller-sized electronic products. Additionally, with the advance of wireless communication technology, electronic products may be configured with an increasing number of antennas. For example, a long term evolution (LTE) wireless communication system and a wireless local area network standard IEEE 802.11n both support multi-input multi-output (MIMO) communication technology, i.e. an electronic product is capable of concurrently receiving/transmitting wireless signals via multiple (or multiple sets of) antennas, to vastly increase system throughput and transmission distance without increasing system bandwidth or total transmission power expenditure, thereby effectively enhancing spectral efficiency and transmission rate for the wireless communication system, as well as improving communication quality.

The LTE wireless communication system includes 44 bands which cover from 698 MHz to 3800 MHz. Due to the bands being separated and disordered, a mobile system operator may use multiple bands simultaneously in the same country or area. Under such a situation, conventional dual polarization antennas may not be able to cover all the bands, such that transceivers of the LTE wireless communication system cannot receive and transmit wireless signals of multiple bands. Therefore, it is a common goal in the industry to design antennas that suit both transmission demands, as well as dimension and functionality requirements.

SUMMARY OF THE INVENTION

Therefore, the present invention provides a multiband antenna and a multiband antenna configuration method to cover a plurality of frequency bands, provide high gain, have board bandwidth, improve isolation, and effectively reduce antenna dimensions.

An embodiment of the present invention discloses a multiband antenna configuration method, adapted to configure a multiband antenna for transmitting and receiving radio signals in a plurality of frequency bands. The multiband antenna configuration method comprises determining a distance between a magnetic conductor reflector of the multiband antenna and a first radiation portion of the multiband antenna, wherein the magnetic conductor reflector is configured to reflect the radio signals in order to increase gain of the multiband antenna; calculating a first reflection phase value of the magnetic conductor reflector at a first center frequency of a first frequency band in the plurality of frequency bands and a second reflection phase value of the magnetic conductor reflector at a second center frequency of a second frequency band in the plurality of frequency bands according to a configuration requirement corresponding to the distance, wherein the configuration requirement is utilized to make the radio signals and reflection of the radio signals interfere constructively in at least one position in space; determining a length and a width of the multiband antenna; adjusting a material and a geometric feature of the magnetic conductor reflector to change a curve representing relationship between a plurality of reflection phases of the magnetic conductor reflector and a plurality of frequencies, and to make a first reflection phase corresponding to the first center frequency equal to the first reflection phase value and a second reflection phase corresponding to the second center frequency equal to the second reflection phase value; and determining the material and the geometric feature of the magnetic conductor reflector according to the curve representing the relationship between the plurality of reflection phases of the magnetic conductor reflector and the plurality of frequencies.

An embodiment of the present invention discloses a multiband antenna, configured to transmit and receive radio signals in a plurality of frequency bands. The multiband antenna comprises a magnetic conductor reflector configured to reflect the radio signals in order to increase gain of the multiband antenna and a first radiation portion disposed on the magnetic conductor reflector. The magnetic conductor reflector and the first radiation portion are disposed according to a multiband antenna configuration method. The multiband antenna configuration method comprises determining a distance between the magnetic conductor reflector and the first radiation portion; calculating a first reflection phase value of the magnetic conductor reflector at a first center frequency of a first frequency band in the plurality of frequency bands and a second reflection phase value of the magnetic conductor reflector at a second center frequency of a second frequency band in the plurality of frequency bands according to a configuration requirement corresponding to the distance, wherein the configuration requirement is utilized to make the radio signals and reflection of the radio signals interfere constructively in at least one position in space; determining a length and a width of the multiband antenna; adjusting a material and a geometric feature of the magnetic conductor reflector to change a curve representing relationship between a plurality of reflection phases of the magnetic conductor reflector and a plurality of frequencies, and to make a first reflection phase corresponding to the first center frequency equal to the first reflection phase value and a second reflection phase corresponding to the second center frequency equal to the second reflection phase value; and determining the material and the geometric feature of the magnetic conductor reflector according to the curve representing the relationship between the plurality of reflection phases of the magnetic conductor reflector and the plurality of frequencies.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 4D is a field pattern characteristic table for the multiband antenna shown in FIG. 4A.

FIG. 5D is a field pattern characteristic table for the multiband antenna shown in FIG. 5A.

DETAILED DESCRIPTION

Figure 1A:
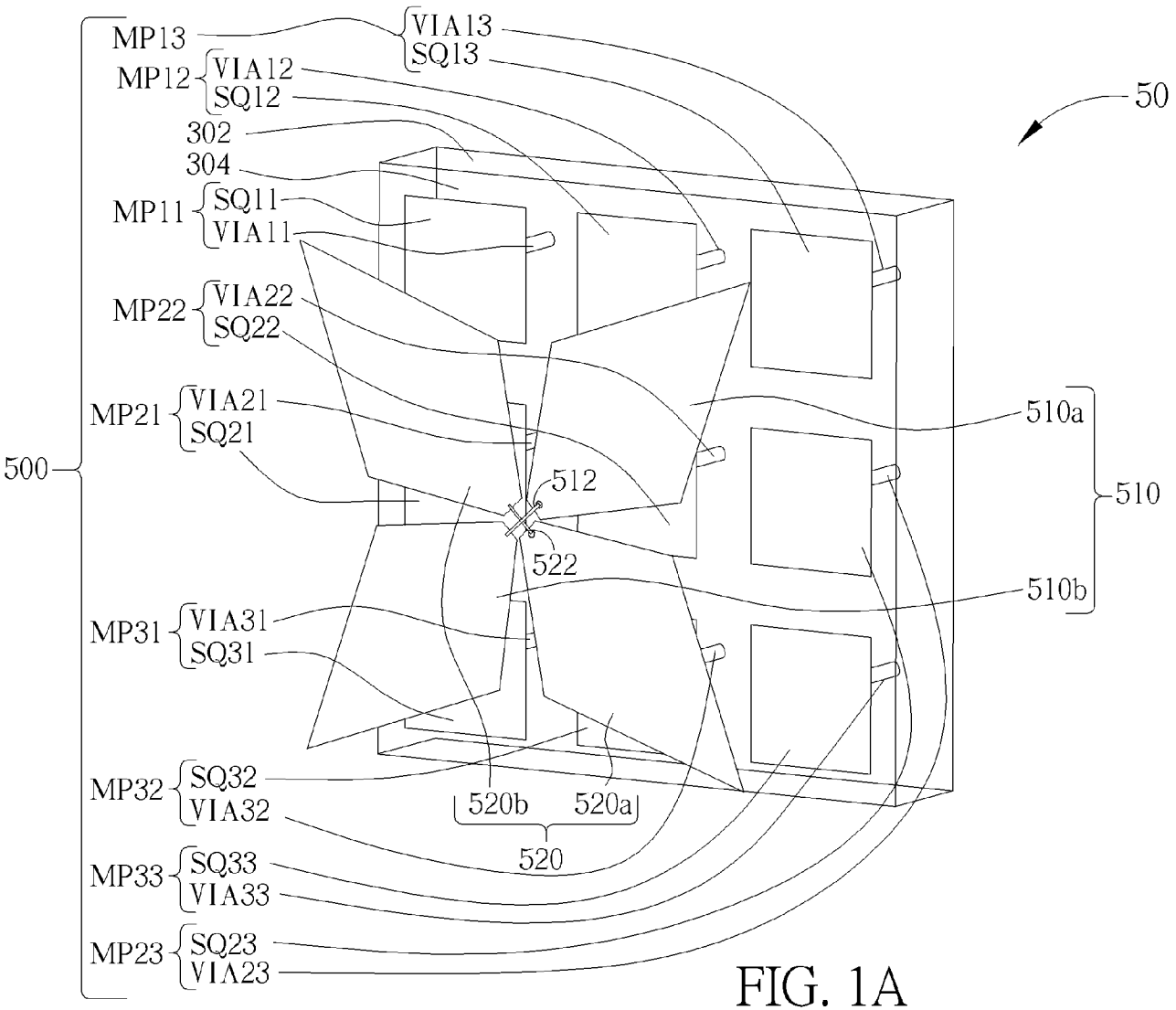
FIG. 1A is a schematic diagram illustrating a front side of a multiband antenna according to an embodiment of the present invention.

A dual-input dual-output LTE wireless communication system can transmit and receive wireless signals with a dual polarization antenna. Regarding different frequency bands of the LTE wireless communication system, for example, Band 20 (upload in the band of 832 MHz-862 MHz and download in the band of 791 MHz-821 MHz) and Band1 (downlink operating from 2620 MHz to 2690 MHz and uplink operating from 2500 MHz to 2570 MHz), the dual polarization antenna must meet the requirements for Band 20 and Band 7 by means of its first higher order mode and third higher order mode simultaneously. Moreover, apart from the requirements of system electronic characteristics, physical dimensions of the dual polarization antenna should be minimized. In such a condition, the present invention uses a dipole antenna structure as a radiating element to enhance the isolation of two polarizations and to reduce side lobes, and adds a reflecting element to increase antenna gain. In other words, the present invention aims to provide a multiband antenna achieving higher gain, broader bandwidth, higher isolation and smaller size.

If the reflecting element is (or close to) a perfect electric conductor (PEC), basically any radio wave incident on a PEC is reflected. Moreover, a radio wave, when reflected, undergoes a phase shift, and for radio waves of different frequencies, the reflected waves are nominally 180 degrees out of phase with the incident waves. Therefore, to ensure a reflected radio signal bounced back from the reflecting element in phase with the incident radio signal, which is transmitted and received by the radiating element, and to achieve constructive interference, spacing between the reflecting element and the radiating element is typically about ¼ of a wavelength of the radio signal. For an antenna operated in multiple frequency bands, the spacing is designed to be a quarter of the longest wavelength in order to optimize the antenna when the antenna operates on its first harmonics. For example, the spacing is 90.4 mm if the wavelength is 361.4 mm and the frequency is 830 MHz. However, the spacing is too long regarding shorter wavelengths in other bands such as wavelengths at the second harmonic frequency (e.g., 1853 MHz) and the third harmonic frequency (e.g., 2480 MHz), and hence the radiated fields cannot all add up in phase. For example, the contributions of the reflected radio signal and the incident radio signal at 830 MHz are designed to add up in phase to enhance the total intensity, while, at 1853 MHz, the main lobe in the radiation pattern is dented because of interference. Also, the reflected radio signal makes a contribution to the incident radio signal but the side lobes in the radiation pattern are big. In other words, a PEC used as a reflecting element cannot optimize reflection contributions for all the frequencies.

In order to solve the aforementioned problem, a reflecting element is changed to be (or close to) a perfect magnetic conductor (PMC). A PMC reflects a radio wave with zero degree phase change; as a result, when the reflecting element is disposed next to the radiating element, a reflected radio signal bounced back from the reflecting element is in phase with the incident radio signal, which is transmitted and received by the radiating element, thereby achieving constructive interference. Similarly, the reflecting element may be an artificial magnetic conductor (AMC) of a periodic structure. However, the reflection phase of an AMC is in a range of −180° to 180° corresponding to different frequencies, and existing structures of an AMC achieve the condition of a PMC only in a particular narrow frequency range. For an antenna operated in multiple frequency bands, materials and geometric features of the AMC reflecting element may be properly designed to produce a zero reflection phase at the center frequency of a specific frequency band—for example, the reflection phase of a first center frequency of a first frequency band (e.g., Band 20) and the reflection phase of a second center frequency of a second frequency band (e.g., Band 7) may be respectively adjusted to zero. However, the slopes of the curve representing the relationship between frequencies and reflection phases at the center frequencies (especially the second center frequency) are steep, meaning that the phase variation away from the center frequencies is large, and hence reflection phase ranges corresponding to the first and second frequency bands fail to be close to zero degrees, leading to smaller bandwidth over which the desired zero-degree condition is achieved to given tolerance. That is to say, the bandwidth of the antenna is limited.

Figure 1B:
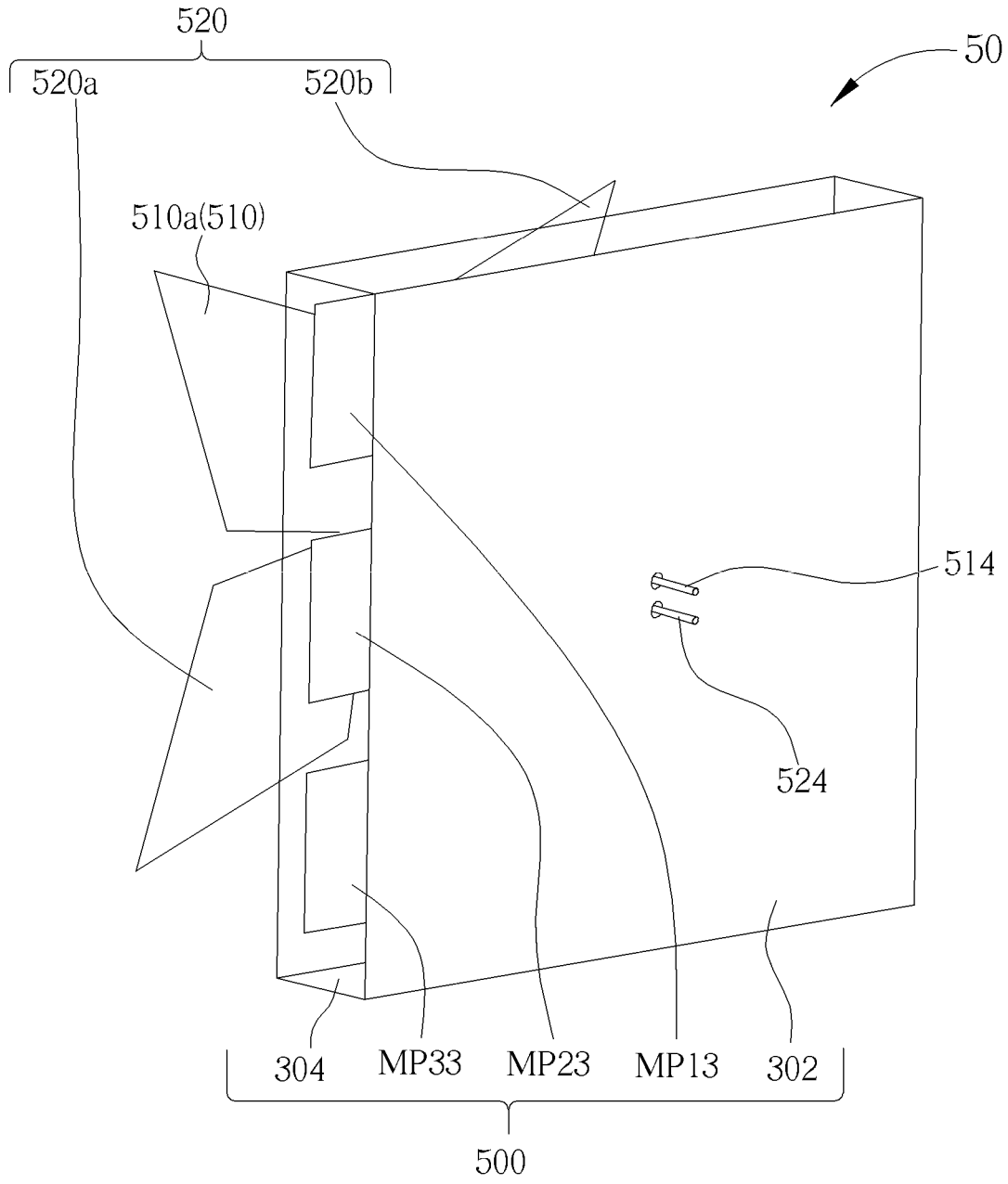
FIG. 1B is a schematic diagram illustrating a back side of the multiband antenna shown in FIG. 1A.
Figure 1C:
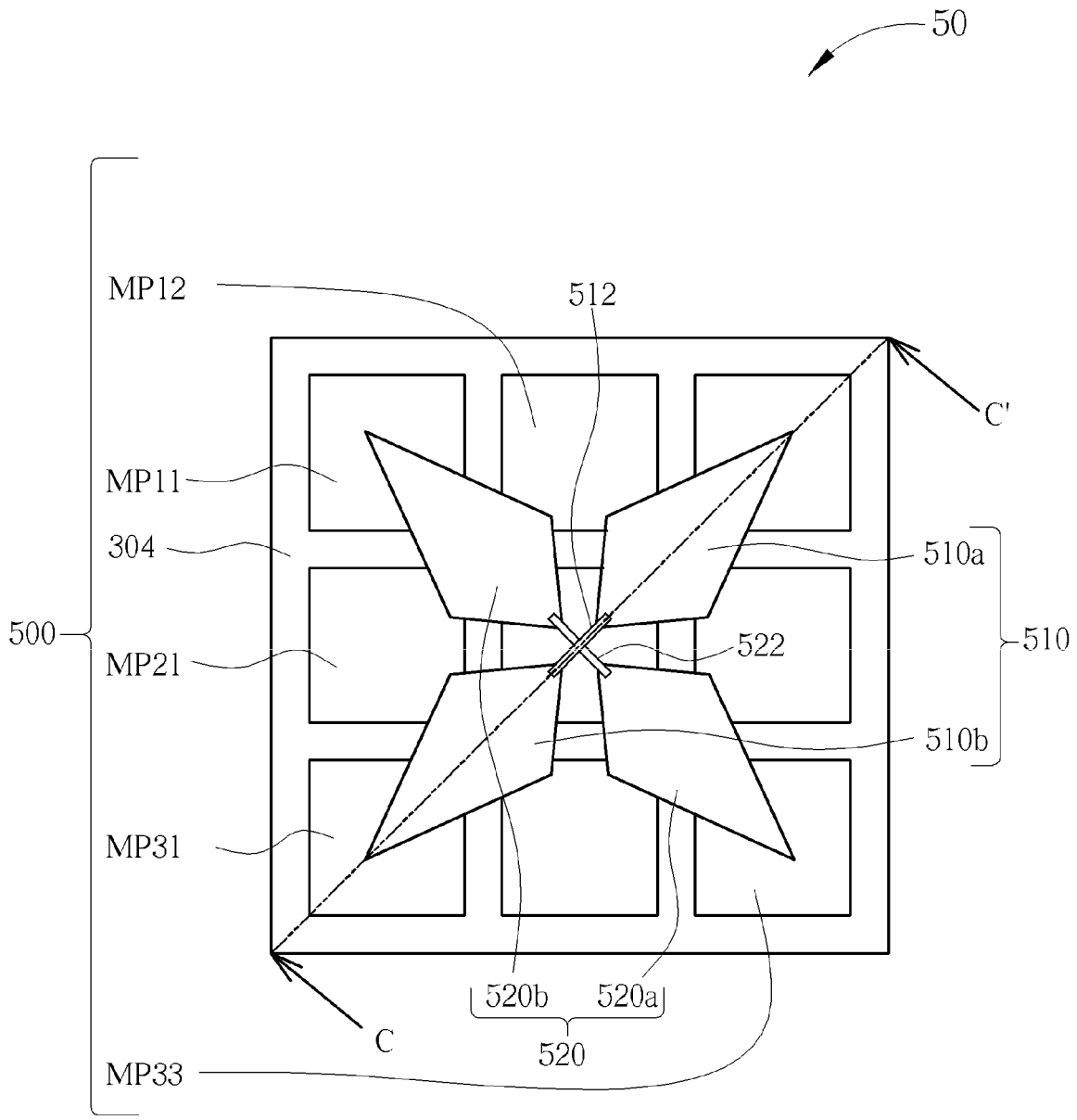
FIG. 1C is a top-view schematic diagram illustrating the multiband antenna shown in FIG. 1A.
Figure 1D:
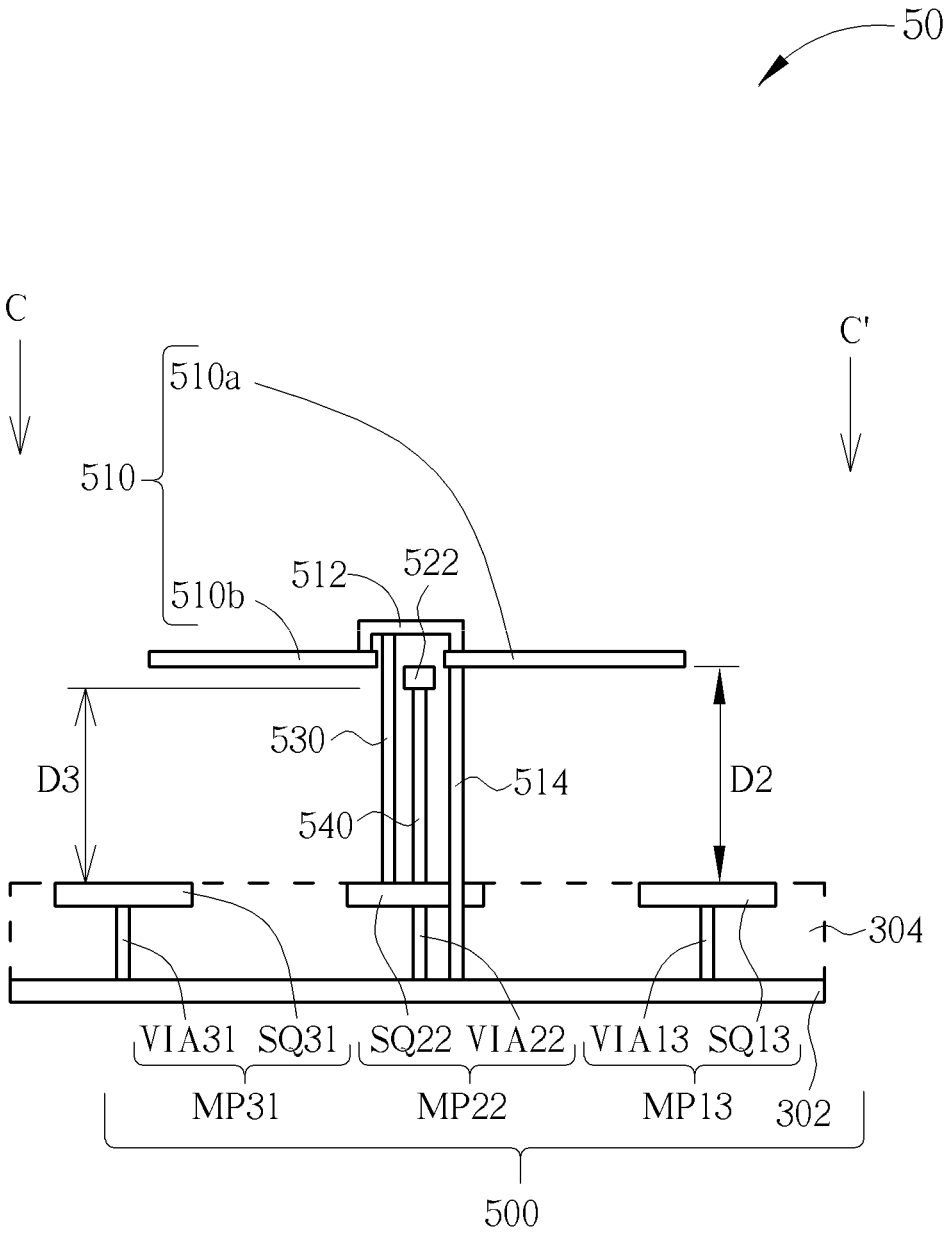
FIG. 1D is a cross-sectional view diagram of the multiband antenna taken along a cross-sectional line C-C' in FIG. 1C.
Figure 1E:
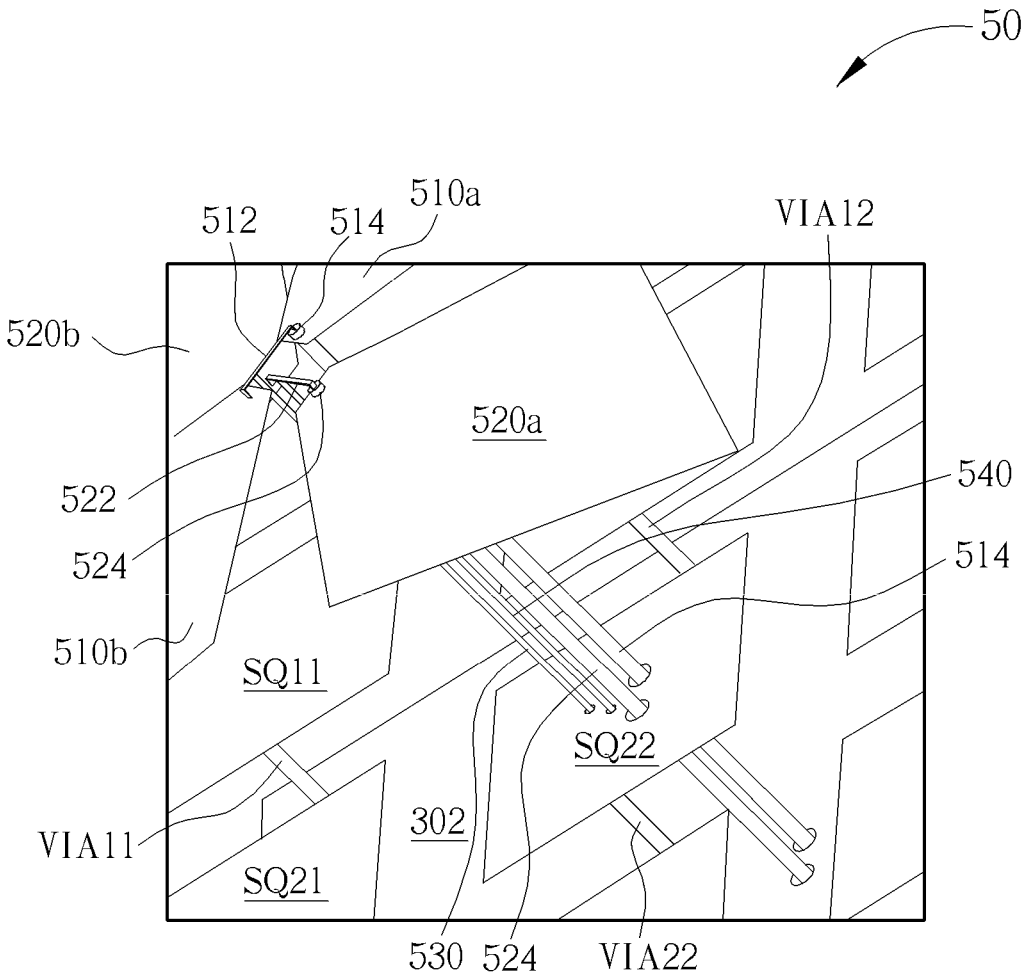
FIG. 1E is an enlarged schematic diagram illustrating a portion of the multiband antenna shown in FIG. 1A.

In order to solve the aforementioned problem further, an embodiment of the present invention provides a multiband antenna 50 as shown in FIGS. 1A to 1E. FIG. 1A is a schematic diagram illustrating a front side of a multiband antenna 50 according to an embodiment of the present invention. FIG. 1B is a schematic diagram illustrating aback side of the multiband antenna 50. FIG. 1C is a top-view schematic diagram illustrating the multiband antenna 50. FIG. 1D is a cross-sectional view diagram of the multiband antenna 50 taken along a cross-sectional line C-C' in FIG. 1C. FIG. 1E is an enlarged schematic diagram illustrating a portion of the multiband antenna 50. As shown in FIGS. 1A-1E, the multiband antenna 50 comprises a magnetic conductor reflector 500, radiation portions 510, 520 and supporting elements 530, 540. The magnetic conductor reflector 500 is an AMC with a mushroom-type structure and comprises a metallic sheet 302, a spacer layer 304 and a plurality of metallic protrusions MP11-MP33 regularly arranged to form a 3×3 array. The metallic protrusions MP11-MP33 respectively comprise metallic patches SQ11-SQ33 (also referred to as reflection units) and metallic vias VIA11-VIA33 to substantially form a mushroom-like structure and are disposed on the metallic sheet 302 to be partially electrically connected to the metallic sheet 302. The spacer layer 304 fills the space between the metallic sheet 302 and the metallic protrusions MP11-MP33. The radiation portions 510, 520 are the main radiating elements configured to transmit and receive radio signals, wherein the radiation portion 510 is a Bishop's Hat dipole antenna of 45-degree slant polarized and the radiation portion 520 is a Bishop's Hat dipole antenna of 135-degree slant polarized—that is, the centerlines of the radiation portions 510 and 520 are substantially perpendicular so as to transmit and receive radio signals of mutually orthogonal polarizations. Moreover, a Bishop's Hat dipole antenna can increase bandwidth, utilize space effectively, and minimize the overlap between the radiation portions 510 and 520, thereby enhancing isolation.

As shown in FIG. 1D, the supporting elements 530, 540 are disposed between the radiation portions 510, 520 and the magnetic conductor reflector 500 to fix and separate the radiation portions 510, 520 and the magnetic conductor reflector 500 respectively by distances D2 and D3, such that the radiation portions 510, 520 and the magnetic conductor reflector 500 are electrically isolated. As shown in FIG. 1E, energy is fed in the radiation portions 510, 520 through transmission lines, wherein central conductors 512, 522 of the transmission lines are respectively connected to the radiation plate 510*b* of the radiation portion 510 and the radiation plate 520*b* of the radiation portion 520, and mesh conductors 514, 524 of the transmission lines are connected to the radiation plate 510*a* of the radiation portion 510 and the radiation plate 520*a* of the radiation portion 520. It is worth noting that the distances D2 and D3 are substantially in a range of zero to a quarter of an operating wavelength—meaning that the distances D2 and D3 are preferably greater than 0 but less than ¼ of the operating wavelength—and the distances D2 and D3 are set according to a multiband antenna configuration method 60 (discussed below). The distances D2 and D3 are preferably equal, but the distances D2 and D3 may be different for soldering so as to avoid establishing a short circuit between the central conductors 512 and 522 of the transmission lines.

Figure 2:
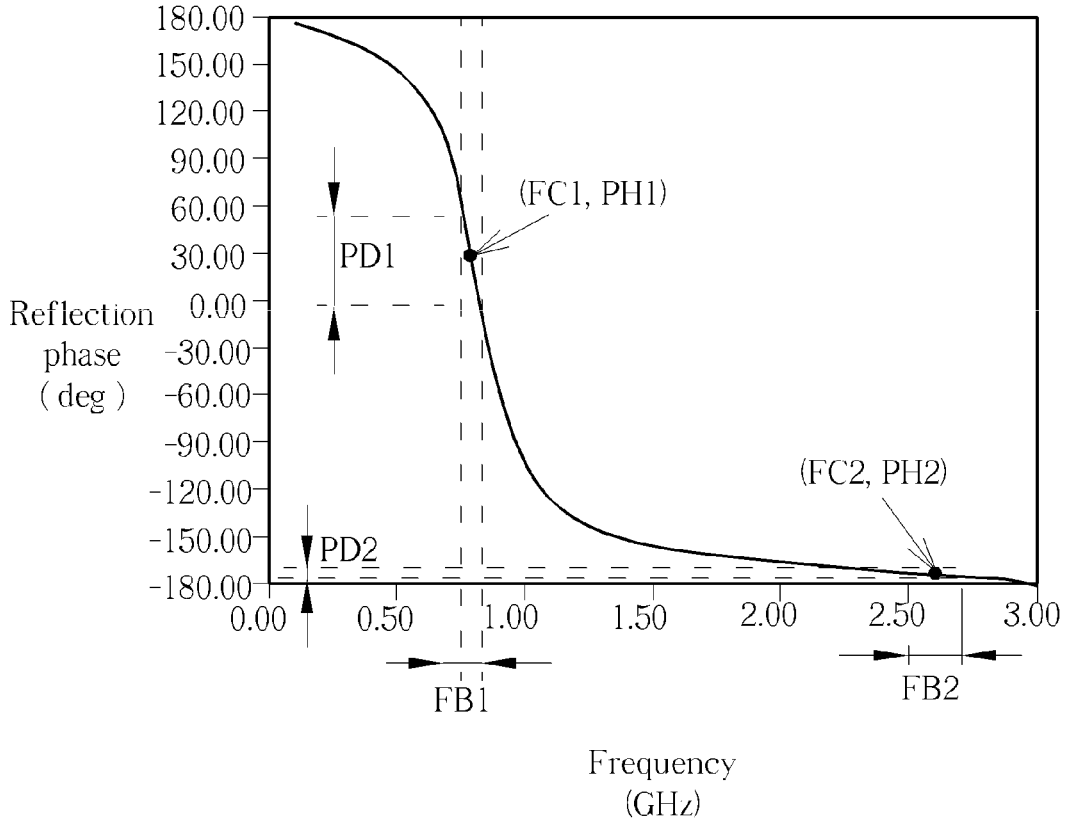
FIG. 2 is a schematic diagram illustrating a curve representing relationship between frequencies and reflection phases of a magnetic conductor reflector of the multiband antenna shown in FIG. 1A according to an embodiment of the present invention.

In addition, please refer to FIG. 2. FIG. 2 is a schematic diagram illustrating the curve representing the relationship between frequencies and reflection phases of the magnetic conductor reflector 500 of the multiband antenna 50 according to an embodiment of the present invention. As shown in FIG. 2, a frequency band FB1 (e.g., Band 20) corresponds to a reflection phase range PD1, and a center frequency FC1 of the frequency band FB1 corresponds to a reflection phase PH1. Similarly, a frequency band FB2 (e.g., Band 7) corresponds to a reflection phase range PD2, and a center frequency FC2 of the frequency band FB2 corresponds to a reflection phase PH2.

Significantly, according to the multiband antenna configuration method 60, the center frequency FC1 of the frequency band FB1 and the center frequency FC2 of the frequency band FB2 no longer correspond to the reflection phase of 0 degrees so as to increase the bandwidth of the multiband antenna.

Briefly, with the multiband antenna configuration method 60, which properly determines the distances D2, D3 and the materials and the geometric features of the magnetic conductor reflector 500, the reflected radio signals bounced back from the magnetic conductor reflector 500 are respectively in phase with the incident radio signals in multiple frequency bands, which are transmitted and received by the radiation portions 510 and 520, thereby achieving constructive interference to increase the gain of the multiband antenna 50 and minimize the size of the multiband antenna 50. Furthermore, the mutually perpendicular radiation portions 510 and 520 are Bishop's Hat dipole antennas, such that bandwidth increases, space is utilized effectively, and the overlap between the radiation portions 510 and 520 is smaller to enhance isolation of different polarization.

Figure 3:
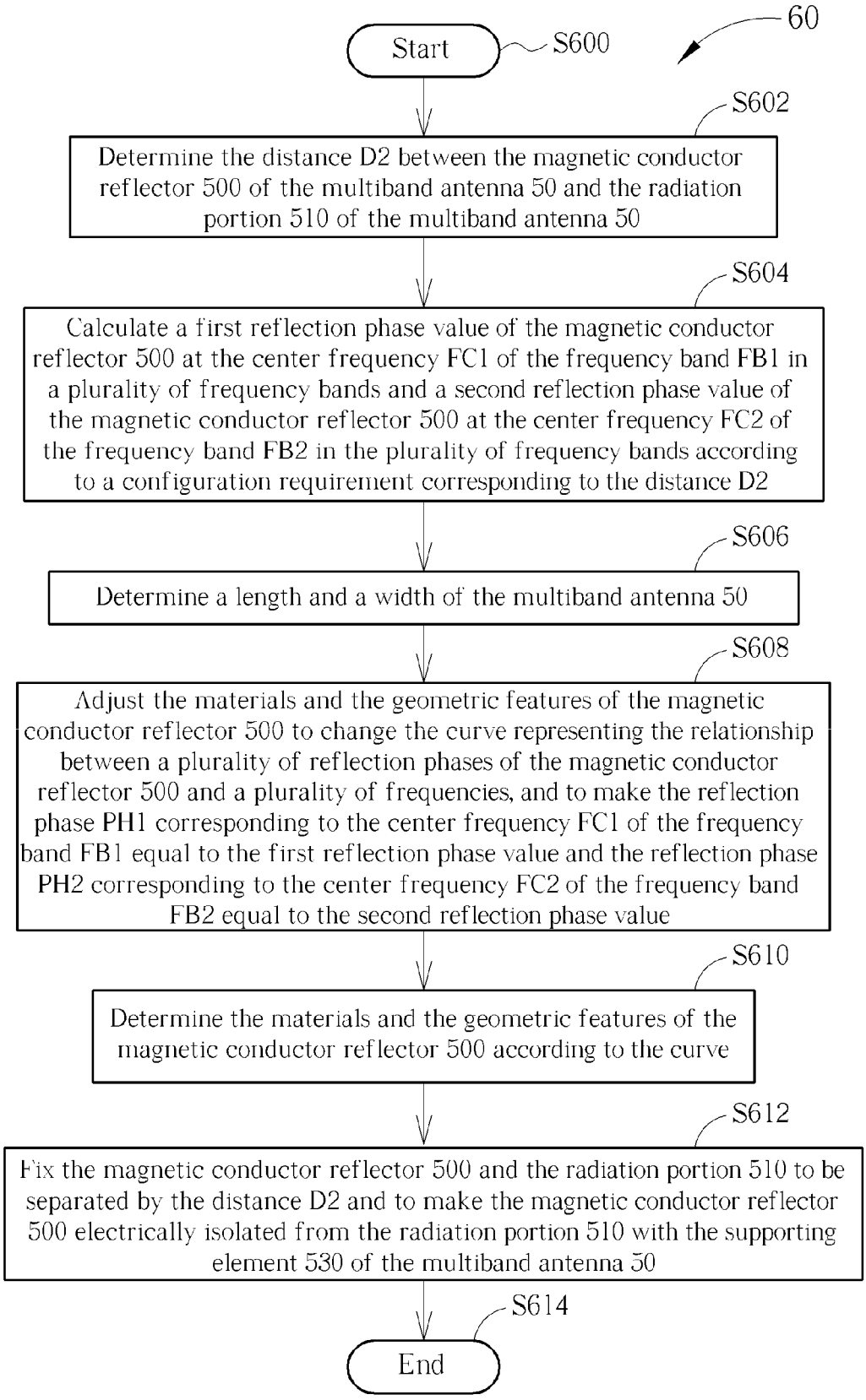
FIG. 3 is a flow schematic diagram illustrating a multiband antenna configuration method adapted to the multiband antenna shown in FIG. 1A according to an embodiment of the present invention.

Please refer to FIG. 3. FIG. 3 is a flow schematic diagram illustrating the multiband antenna configuration method 60 adapted to the multiband antenna 50 according to an embodiment of the present invention. The multiband antenna configuration method 60 includes the following steps:

Step S600: Start.

Step S602: Determine the distance D2 between the magnetic conductor reflector 500 of the multiband antenna 50 and the radiation portion 510 of the multiband antenna 50.

Step S604: Calculate a first reflection phase value of the magnetic conductor reflector 500 at the center frequency FC1 of the frequency band FB1 in a plurality of frequency bands and a second reflection phase value of the magnetic conductor reflector 500 at the center frequency FC2 of the frequency band FB2 in the plurality of frequency bands according to a configuration requirement corresponding to the distance D2.

Step S606: Determine a length and a width of the multiband antenna 50.

Step S608: Adjust the materials and the geometric features of the magnetic conductor reflector 500 to change the curve representing the relationship between a plurality of reflection phases of the magnetic conductor reflector 500 and a plurality of frequencies, and to make the reflection phase PH1 corresponding to the center frequency FC1 of the frequency band FB1 equal to the first reflection phase value and the reflection phase PH2 corresponding to the center frequency FC2 of the frequency band FB2 equal to the second reflection phase value.

Step S610: Determine the materials and the geometric features of the magnetic conductor reflector 500 according to the curve.

Step S612: Fix the magnetic conductor reflector 500 and the radiation portion 510 to be separated by the distance D2 and to make the magnetic conductor reflector 500 electrically isolated from the radiation portion 510 with the supporting element 530 of the multiband antenna 50.

Step S614: End.

In other words, to appropriately dispose the magnetic conductor reflector 500, the radiation portions 510, 520 and the supporting elements 530, 540 of the multiband antenna 50, the distance D2 between the magnetic conductor reflector 500 and the radiation portion 510 is first determined in the multiband antenna configuration method 60. Then, according to the configuration requirement, a first reflection phase value corresponding to the distance D2 from the magnetic conductor reflector 500 (e.g., 45.4 mm) at the center frequency FC1 (e.g., 826.5 MHz) of the frequency band FB1 (e.g., Band 20) in a plurality of frequency bands is calculated, and a second reflection phase value corresponding to the distance D2 from the magnetic conductor reflector 500 at the center frequency FC2 (e.g., 2595 MHz) of the frequency band FB2 (e.g., Band 7) in the plurality of frequency bands is also calculated. Specifically, the configuration requirement aims to make an incident radio signal and its reflected radio signal interfere constructively in (at least one) positions in space. For example, because the distance D2 is substantially in a range of zero to a quarter of an operating wavelength, according to the configuration requirement, the first reflection phase value θ1 and the second reflection phase value θ2 can respectively satisfy the following relation:

$$\theta 1=4\pi D2/\lambda 1 \quad (1),$$

$$\theta 2=4\pi D2/\lambda 2-2\pi \quad (2),$$

where λ1, λ2 respectively denote the wavelengths corresponding to the center frequencies FC1 and FC2. As a result, a first phase difference between an incident radio signal at the center frequency FC1 and its reflection (i.e., the reflected radio signal at the center frequency FC1 from the magnetic conductor reflector 500) in (at least) one position is zero to get interference that is completely constructive. Moreover, the center frequency FC2 is the next frequency that achieves constructive interference for the distance D2 with respect to the center frequency FC1, and thus a second phase difference between an incident radio signal at the center frequency FC2 and its reflection (i.e., the reflected radio signal at the center frequency FC2 from the magnetic conductor reflector 500) in (at least) one position is 2π. The first reflection phase value θ1 can be in a range of 0° to 180° (e.g., 90°), and the second reflection phase value θ2 can be in a range of −180° to 0° (e.g., −77.4°). For example, the first reflection phase value at 826.5 MHz and the second reflection phase value at 2595 MHz corresponding to the magnetic conductor reflector 500 at the distance D2 from the radiation portion 510 are listed in Table 1 below.

TABLE 1

| first reflection phase value (at 826.5 MHz) | second reflection phase value (at 2595 MHz) | distance between the radiation portion and the magnetic conductor reflector |
|---|---|---|
| 114° | −2.1° | 57.5 mm |
| 107° | −24.0° | 53.9 mm |
| 100° | −46.0° | 50.4 mm |
| 90° | −77.4° | 45.4 mm |
| 80° | −108.8° | 40.3 mm |
| 70° | −140.2° | 35.3 mm |
| 63° | −162.2° | 31.8 mm |
| 58° | −177.9° | 29.2 mm |

The length and the width of the multiband antenna 50 are then determined, and meanwhile, the number of the metallic protrusions of the magnetic conductor reflector 500 may be modified. After the distance D2 (e.g., 45.9 mm) between the magnetic conductor reflector 500 and the radiation portion 510 and the length (e.g., 120 mm) and the width (e.g., 120 mm) of the multiband antenna 50 are decided, the materials and the geometric features of the magnetic conductor reflector 500 are adjusted to change the curve representing the relationship between frequencies and reflection phases of the magnetic conductor reflector 500, such that the reflection phase PH1 corresponding to the center frequency FC1 (e.g., 826.5 MHz) of the frequency band FB1 (e.g., Band 20) equals the first reflection phase value (e.g., 90°), and the reflection phase PH2 corresponding to the center frequency FC2 (e.g., 2595 MHz) of the frequency band FB2 (e.g., Band 7) equals the second reflection phase value (e.g., −77.4°). That is to say, the reflected radio signals bounced back from the magnetic conductor reflector 500 at the center frequencies FC1, FC2 are respectively in phase with the incident radio signals at the center frequencies FC1, FC2, which are transmitted and received by the radiation portion 510, in space, thereby achieving constructive interference to increase the gain of the multiband antenna 50. Note that the slope of the curve representing the relationship between frequencies and reflection phases is rather flat when the reflection phase is in a range of 0° to 180° or in a range of −180° to 0°. Therefore, when the first reflection phase value is chosen to be in a range of 0° to 180° (e.g., 90°), and when the second reflection phase value is chosen to be in a range of −180° to 0° (e.g., −77.4°), the reflected radio signals bounced back from the magnetic conductor reflector 500 in the frequency bands FB1, FB2 and the incident radio signals in the frequency bands FB1, FB2, which are transmitted and received by the radiation portion 510, substantially all add up in phase in space, and the bandwidth is wider.

After the materials and the geometric features of the magnetic conductor reflector 500 are decided according to the curve representing the relationship between frequencies and reflection phases, the radiation portion 510 may be fixed and separated by the distance D2 from the magnetic conductor reflector 500 with the supporting element 530 of the multiband antenna 50, such that the magnetic conductor reflector 500 and the radiation portion 510 are electrically isolated. Similarly, the radiation portion 520 may be fixed and separated by the distance D3 from the magnetic conductor reflector 500. Nevertheless, since the distance D2 is substantially equal to the distance D3, the radiation portion 520 may be fixed directly by the supporting element 540 and be separated by the distance D2 from the magnetic conductor reflector 500.

Accordingly, with the multiband antenna configuration method 60, the distances D2, D3 and the materials and the geometric features of the magnetic conductor reflector 500 can be properly determined; therefore, the reflected radio signals in a plurality of frequency bands bounced back from the magnetic conductor reflector 500 are respectively in phase with the incident radio signals in the plurality of frequency bands, which are transmitted and received by the radiation portions 510, 520, in space, thereby achieving constructive interference to increase the gain of the multiband antenna 50. In addition, because the slope of the curve representing the relationship between frequencies and reflection phases is rather flat when the reflection phase is in a range of 0° to 180° or in a range of −180° to 0°, the bandwidth of the multiband antenna 50 is wider. The distances D2 and D3 are substantially in a range of zero to a quarter of the wavelengths of the radio signals, and the length and the width of the multiband antenna 50 can be determined arbitrarily. Thus, the size of the multiband antenna 50 can be minimized.

Figure 4A:
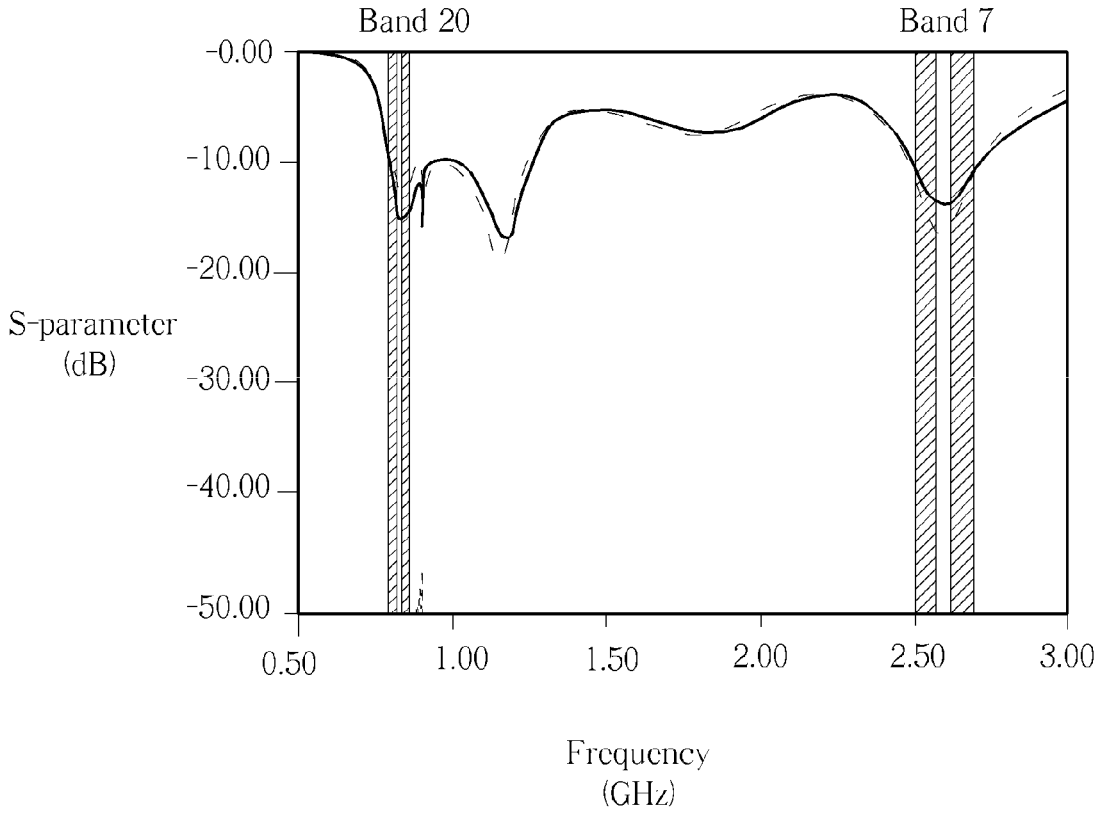
FIG. 4A is a schematic diagram illustrating antenna resonance simulation results of the multiband antenna shown in FIG. 1A.
Figure 4B:
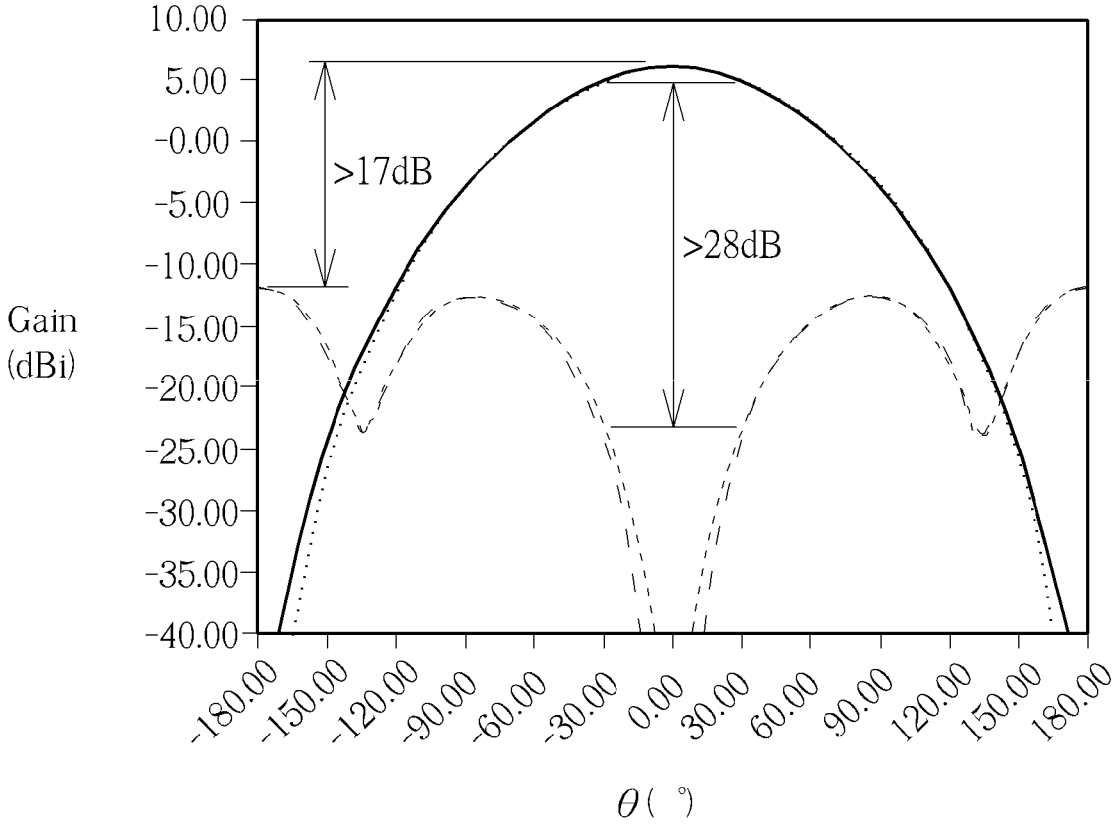
FIGS. 4B and 4C are schematic diagrams illustrating antenna pattern characteristic simulation results of the multiband antenna shown in FIG. 4A at 821 MHz and 2570 MHz, respectively.
Figure 4C:
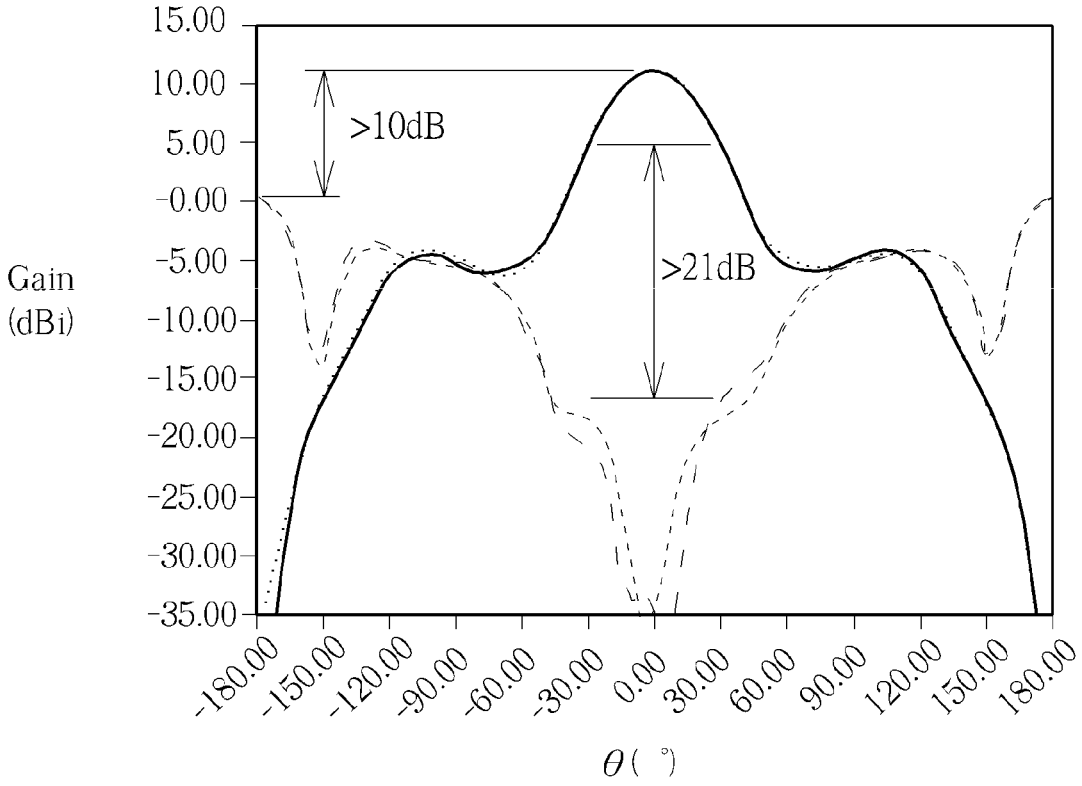

Simulation and measurement may be employed to determine whether the radiation pattern of the multiband antenna 50 at different frequencies meets system requirements. Please refer to FIGS. 4A to 4D, wherein the length and the width of the multiband antenna 50 are set to be 120 mm, the distance D2 is set to be 45.9 mm, the thickness of the magnetic conductor reflector 500 is set to be 22.2 mm, and thus the total height of the multiband antenna 50 is set to be 68.1 mm. FIG. 4A is a schematic diagram illustrating antenna resonance simulation results of the multiband antenna 50 with the dimensions mentioned above. In FIG. 4A, antenna resonance simulation results of the radiation portions 510 and 520 of the multiband antenna 50 are presented by long dashed and solid lines, respectively, and antenna isolation simulation results of the radiation portions 510 and 520 of the multiband antenna 50 are presented by short dashed lines. It can be seen that, in Band 7 and Band 20, the return loss (S11) of the radiation portions 510 and 520 of the multiband antenna 50 have values below −9 dB and −10.7 dB, respectively, and isolation between the radiation portions 510 and 520 is at least 50 dB or above. FIGS. 4B and 4C are schematic diagrams illustrating antenna pattern characteristic simulation results of the multiband antenna 50 at 821 MHz and 2570 MHz with the dimensions mentioned above, respectively. In FIGS. 4B and 4C, common polarization radiation pattern of the multiband antenna 50 at 0° is presented by solid line, common polarization radiation pattern of the multiband antenna 50 at 90° is presented by dotted line, cross polarization radiation pattern of the multiband antenna 50 at 0° is presented by long dashed line, and cross polarization radiation pattern of the multiband antenna 50 at 90° is presented by short dashed line. FIG. 4D is a field pattern characteristic table for the multiband antenna 50, and Table 2 is an antenna characteristic table for the multiband antenna 50. FIG. 4D and Table 2 show that the multiband antenna 50 of the present invention meets LTE wireless communication system requirements of Band 7 and Band 20.

TABLE 2

| frequency band | Band 20 | Band 7 |
|---|---|---|
| return loss | >9.0 dB | >10.7 dB |
| isolation | >50.0 dB | >50.0 dB |
| maximum gain | 5.50-6.16 dBi | 10.1-11.1 dBi |
| front-to-back (F/B) ratio | >12.1 dB | >9.2 dB |
| 3 dB beam width | 96°-106° | 39°-42° |
| common polarization to cross polarization (Co/Cx) ratio | >26.7 dB | >18.3 dB |

Figure 5A:
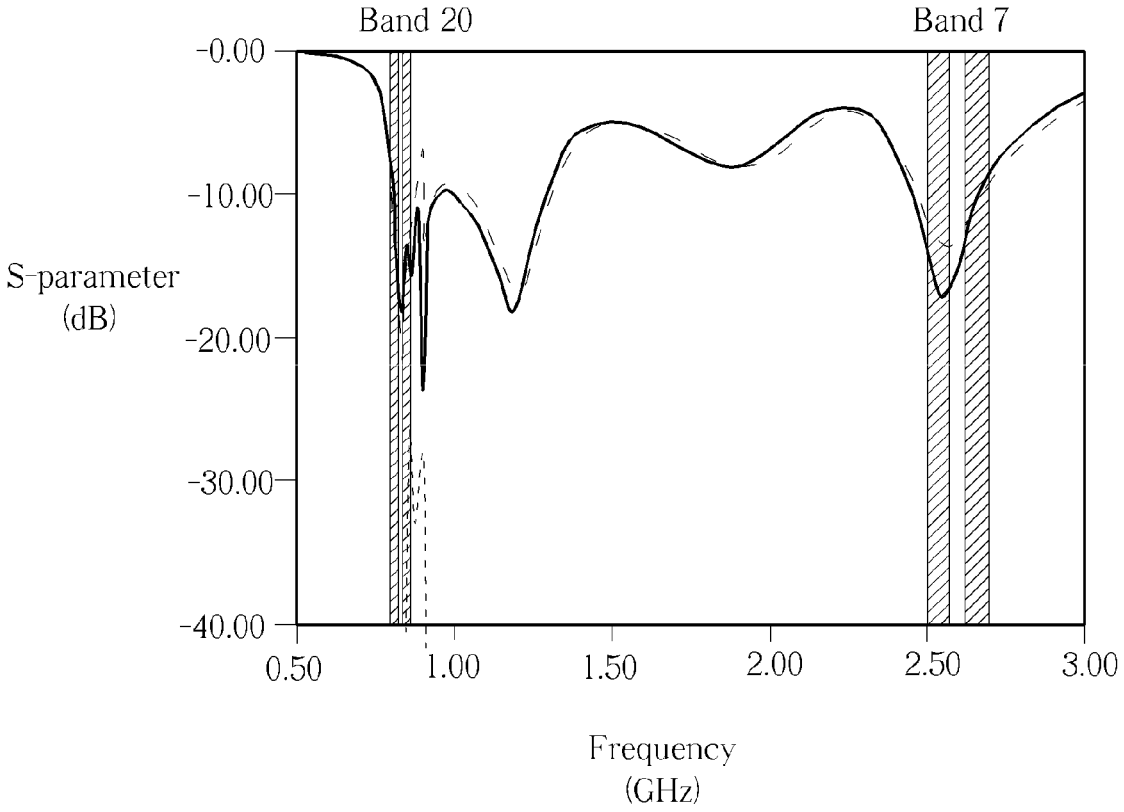
FIG. 5A is a schematic diagram illustrating antenna resonance simulation results of the multiband antenna shown in FIG. 1A.
Figure 5B:
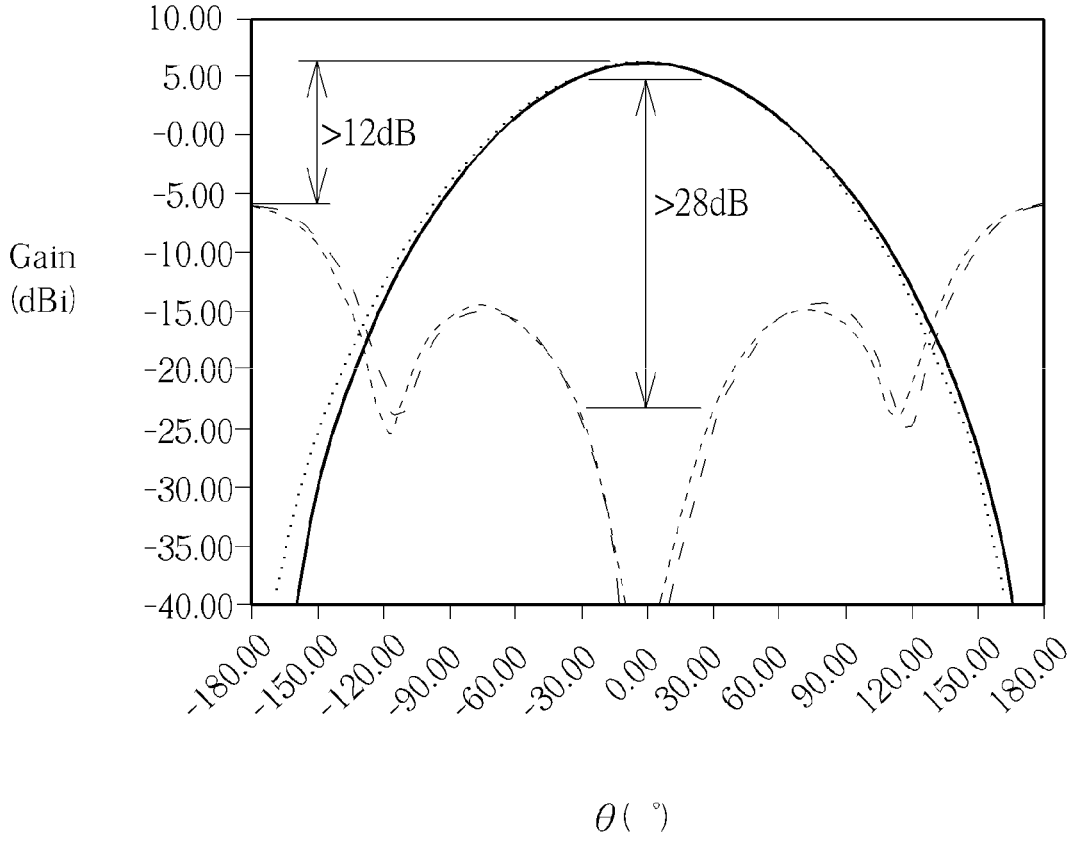
FIGS. 5B and 5C are schematic diagrams illustrating antenna pattern characteristic simulation results of the multiband antenna shown in FIG. 5A at 821 MHz and 2570 MHz, respectively.
Figure 5C:
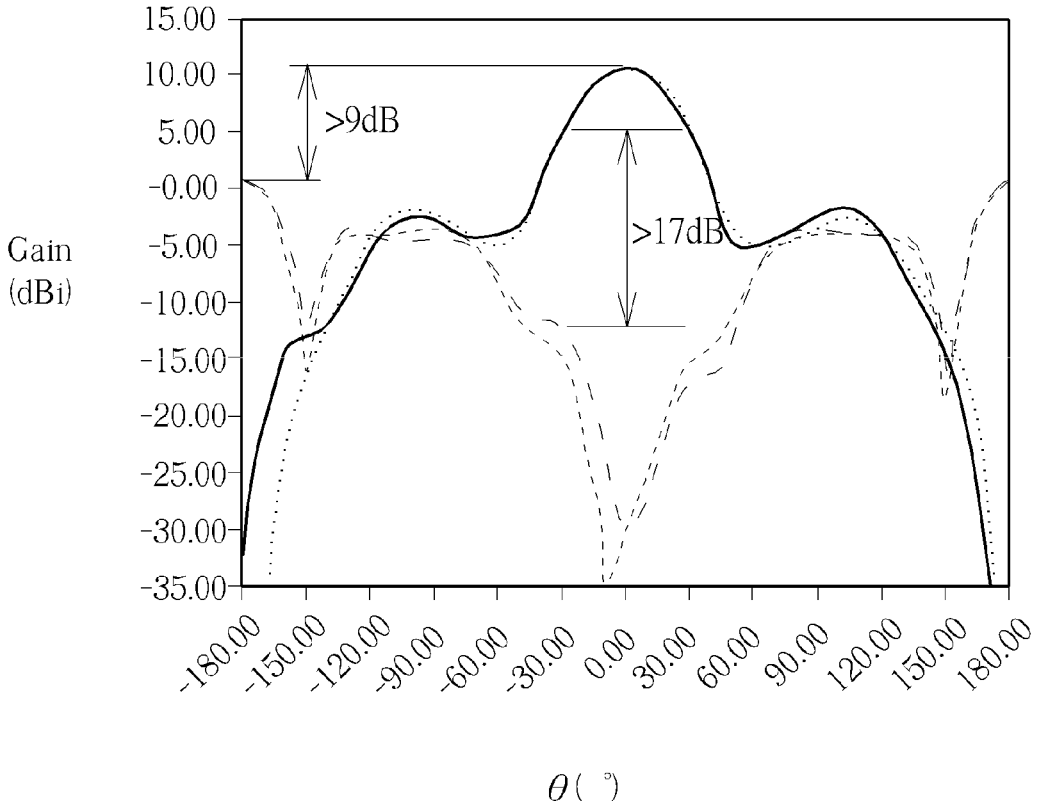

The size of the multiband antenna 50 could be smaller. For example, the length and the width of the multiband antenna 50 are set to be 105 mm, the distance D2 is set to be 43 mm, the thickness of the magnetic conductor reflector 500 is set to be 21.2 mm, and thus the total height of the multiband antenna 50 is set to be 64.2 mm. FIGS. 5A to 5D show related simulation results, wherein FIG. 5A is a schematic diagram illustrating antenna resonance simulation results of the multiband antenna 50 with the dimensions mentioned above. In FIG. 5A, antenna resonance simulation results of the radiation portions 510 and 520 of the multiband antenna 50 are presented by long dashed and solid lines, respectively, and antenna isolation simulation results of the radiation portions 510 and 520 of the multiband antenna 50 are presented by short dashed lines. It can be seen that, in Band 7 and Band 20, the return loss (S11) of the radiation portions 510 and 520 of the multiband antenna 50 have values below −7.2 dB and −9 dB, respectively, and isolation between the radiation portions 510 and 520 are respectively at least 29.7 dB, 43.8 dB or above. FIGS. 5B and 5C are schematic diagrams illustrating antenna pattern characteristic simulation results of the multiband antenna 50 at 821 MHz and 2570 MHz with the dimensions mentioned above, respectively. In FIGS. 5B and 5C, common polarization radiation pattern of the multiband antenna 50 at 0° is presented by solid line, common polarization radiation pattern of the multiband antenna 50 at 90° is presented by dotted line, cross polarization radiation pattern of the multiband antenna 50 at 0° is presented by long dashed line, and cross polarization radiation pattern of the multiband antenna 50 at 90° is presented by short dashed line. FIG. 5D is a field pattern characteristic table for the multiband antenna 50, and Table 3 is an antenna characteristic table for the multiband antenna 50. FIGS. 5A to 5D and Table 3 show that the multiband antenna 50 of the present invention meets LTE wireless communication system requirements of Band 7 and Band 20 even if the size of the multiband antenna 50 get smaller.

TABLE 3

| frequency band | Band 20 | Band 7 |
|---|---|---|
| return loss | >7.2 dB | >9.0 dB |
| isolation | >29.7 dB | >43.8 dB |
| maximum gain | 5.01-6.27 dBi | 9.37-10.6 dBi |
| front-to-back (F/B) ratio | >7.0 dB | >8.3 dB |
| 3 dB beam width | 92°-104° | 40°-44° |
| common polarization to cross polarization (Co/Cx) ratio | >19.6 dB | >16.7 dB |

Please note that, the multiband antenna 50 is an exemplary embodiment of the invention, and those skilled in the art can make alternations and modifications accordingly. For example, the radiation portions 510, 520 are Bishop's Hat dipole antennas, but the present invention is not limited to this and other kinds of dipole antennas such as a bowtie dipole antenna, a diamond dipole antenna and an elliptic dipole antenna may be feasible. The magnetic conductor reflector 500 may have a mushroom-type structure or other types of regular structures. The supporting elements 530 and 540 may be cylindrical bars to fix the radiation portions 510 and 520, and the relative position with respect to the radiation portions 510 and 520 may be properly adjust according to different design considerations. Alternatively, the radiation portions 510 and 520 can be fixed with one single supporting element, and the transmission lines are covered in the supporting element. However, the supporting elements of the present invention are not limited thereto, and the supporting elements may be a dielectric layer, which could fix the radiation portions and the magnetic conductor reflector to electrically isolate the radiation portion from the magnetic conductor reflector. The distances D2 and D3 are substantially in a range of zero to a quarter of the operating wavelengths, but not limited herein. The distance may be adjusted according to different system requirements, and therefore the reflection phase values θ3 and θ4 respectively satisfy the following relation:

$$\theta 3=4\pi D/\lambda 1+2n\pi \quad (3),$$

$$\theta 4=4\pi D/\lambda 2+2m\pi \quad (4),$$

where n, m can be any arbitrary integer. Besides, the multiband antenna 50 is operated in the frequency band FB1, FB2, but not limited thereto the multiband antenna 50 can be operated in a plurality of frequency bands, and by changing the curve representing the relationship between frequencies and reflection phases of the magnetic conductor reflector, the reflected radio signals in the plurality of frequency bands bounced back from the magnetic conductor reflector are respectively in phase with the incident radio signals in the plurality of frequency bands, which are transmitted and received by the radiation portions, in space to achieve constructive interference.

Figure 6:
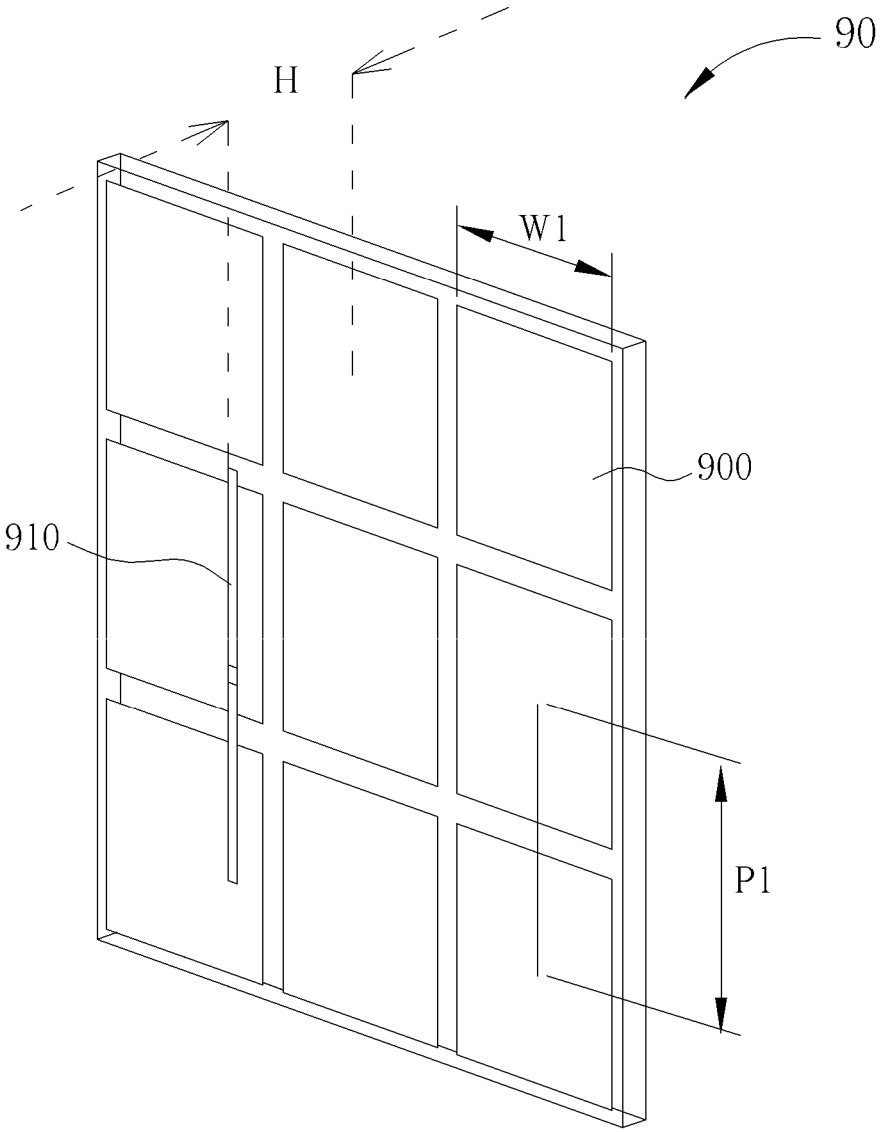
FIG. 6 is a schematic diagram illustrating a dipole antenna disposed on a magnetic conductor reflector according to an embodiment of the present invention.

The magnetic conductor reflector can produce reflection phases from −180° to 180°. Technically, reflection phases from −180° to 180° may be applied in the multiband antenna, except that the reflection phase is related to the distance between the radiation portion and the magnetic conductor reflector and would affect bandwidth—for example, when the reflection phase is 0 degrees, bandwidth is narrow. Table 4 lists the distances between the radiation portion and the magnetic conductor reflector when the reflection phase is 180°, 120°, 60°, 0°, −60°, −120° and −180°, wherein the minimum distance is zero and the maximum distance is one half wavelength long. The multiband antenna can be set respectively according to Table 4. Specifically, please refer to FIGS. 6-10B. FIG. 6 is a schematic diagram illustrating a dipole antenna 90 disposed on the magnetic conductor reflector according to an embodiment of the present invention. Although the structure of the dipole antenna 90 is similar to that of the multiband antenna 50, a radiation portion 910 of the dipole antenna 90 is a dipole antenna, metallic protrusions of a magnetic conductor reflector 900 is arranged into a 3×3 array, a pitch P1 of the metallic protrusions is set to be 100 mm, a width W1 of metallic patches is set to be 95 mm, and a spacer layer is formed from air.

Figure 7A:
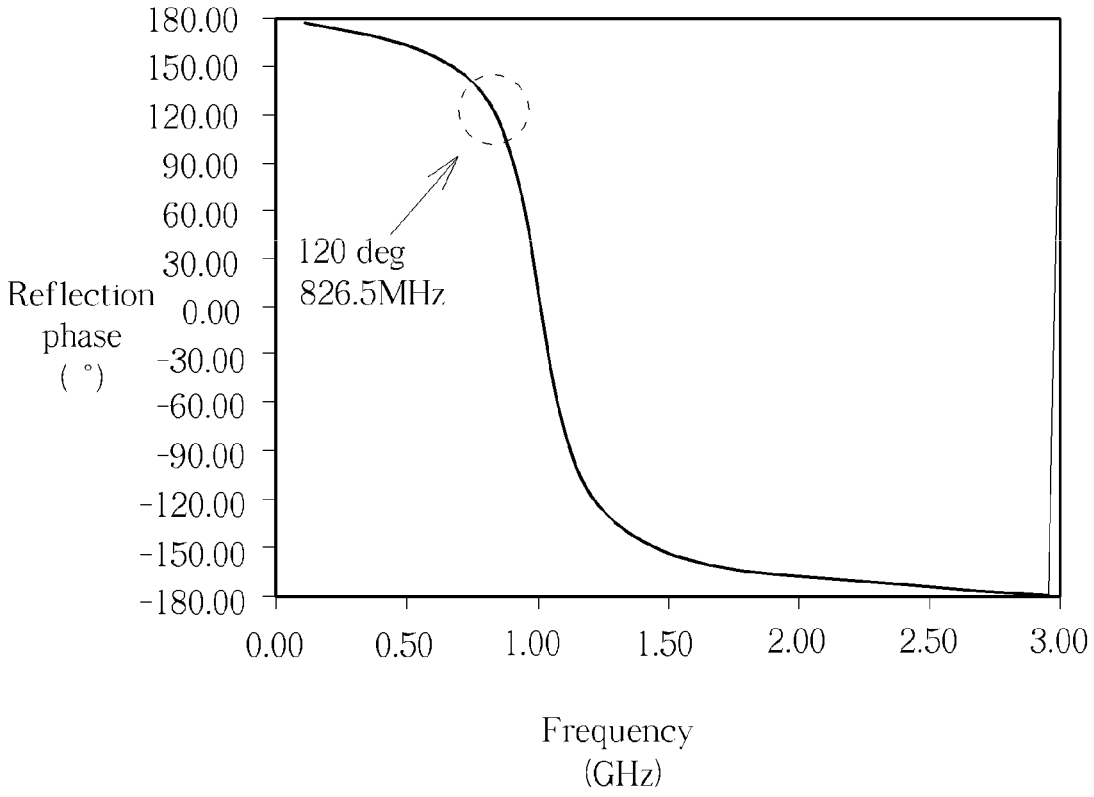
FIG. 7A is a schematic diagram illustrating a curve representing relationship between frequencies and reflection phases of a magnetic conductor reflector shown in FIG. 6.
Figure 7B:
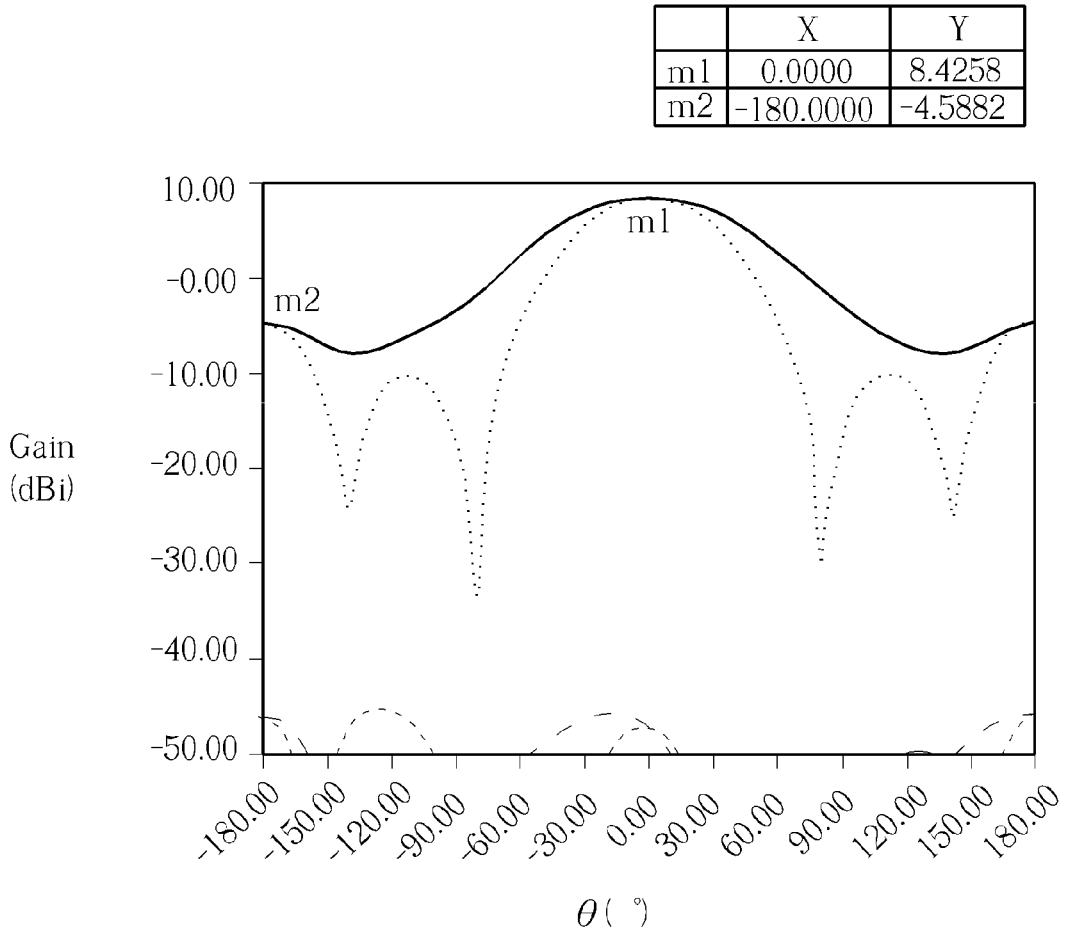
FIG. 7B is a schematic diagram illustrating antenna pattern characteristic simulation results of the dipole antenna shown in FIG. 6 at 826.5 MHz.
Figure 8A:
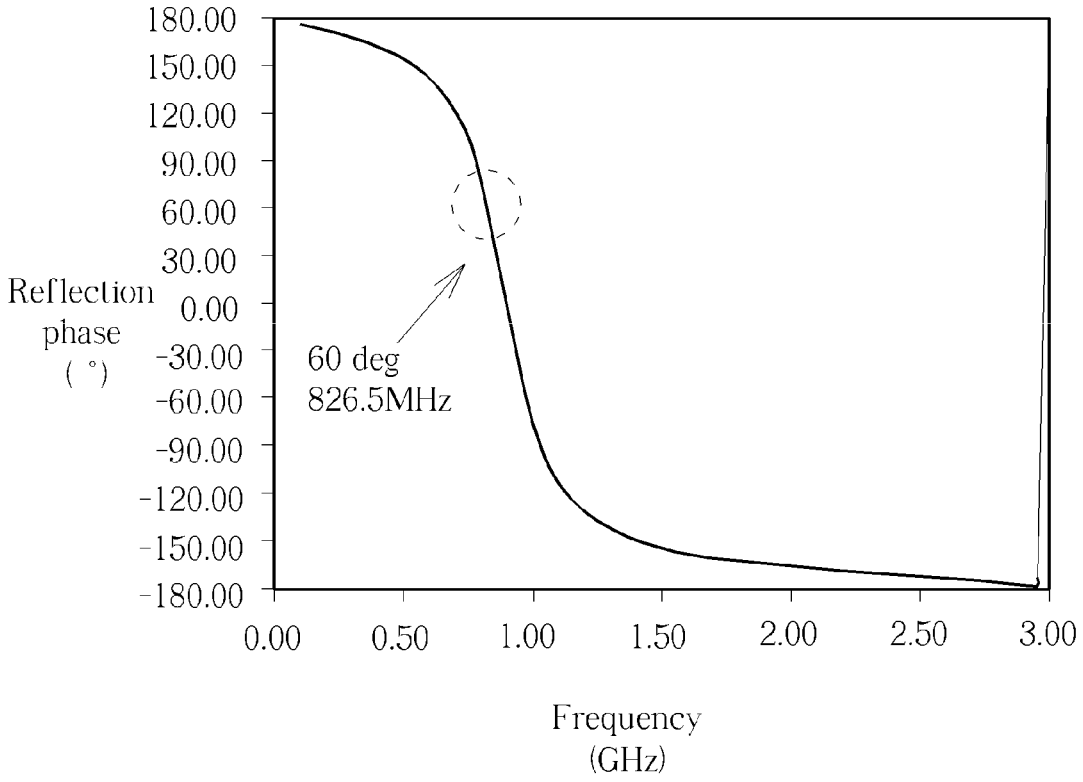
FIG. 8A is a schematic diagram illustrating the curve representing the relationship between frequencies and reflection phases of the magnetic conductor reflector shown in FIG. 6.
Figure 8B:
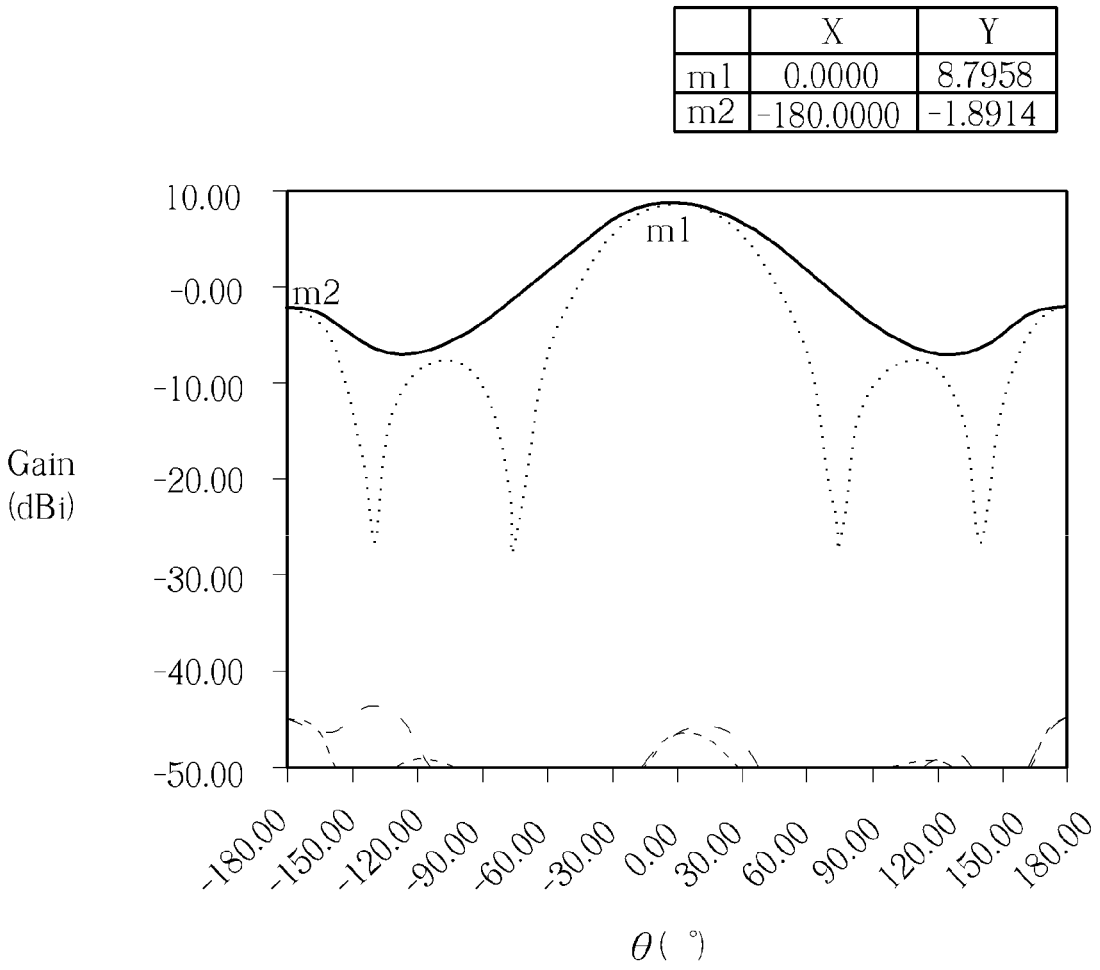
FIG. 8B is a schematic diagram illustrating antenna pattern characteristic simulation results of the dipole antenna shown in FIG. 6 at 826.5 MHz.
Figure 9A:
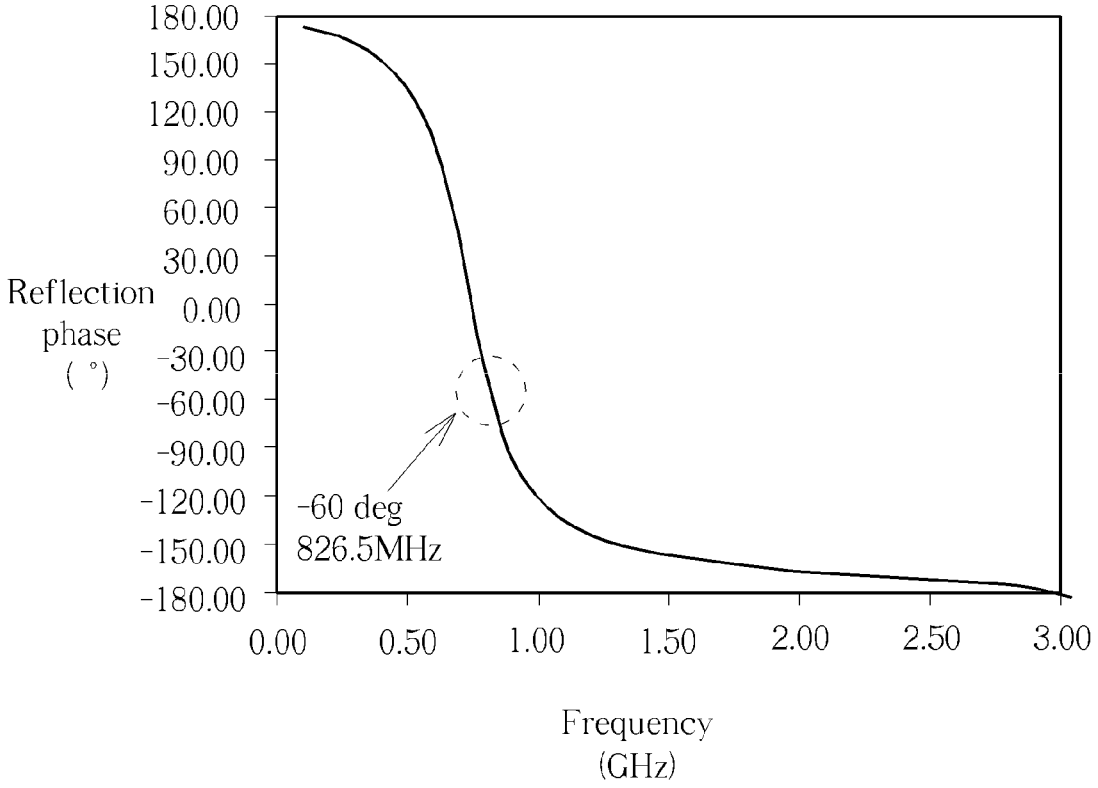
FIG. 9A is a schematic diagram illustrating the curve representing the relationship between frequencies and reflection phases of the magnetic conductor reflector shown in FIG. 6.
Figure 9B:
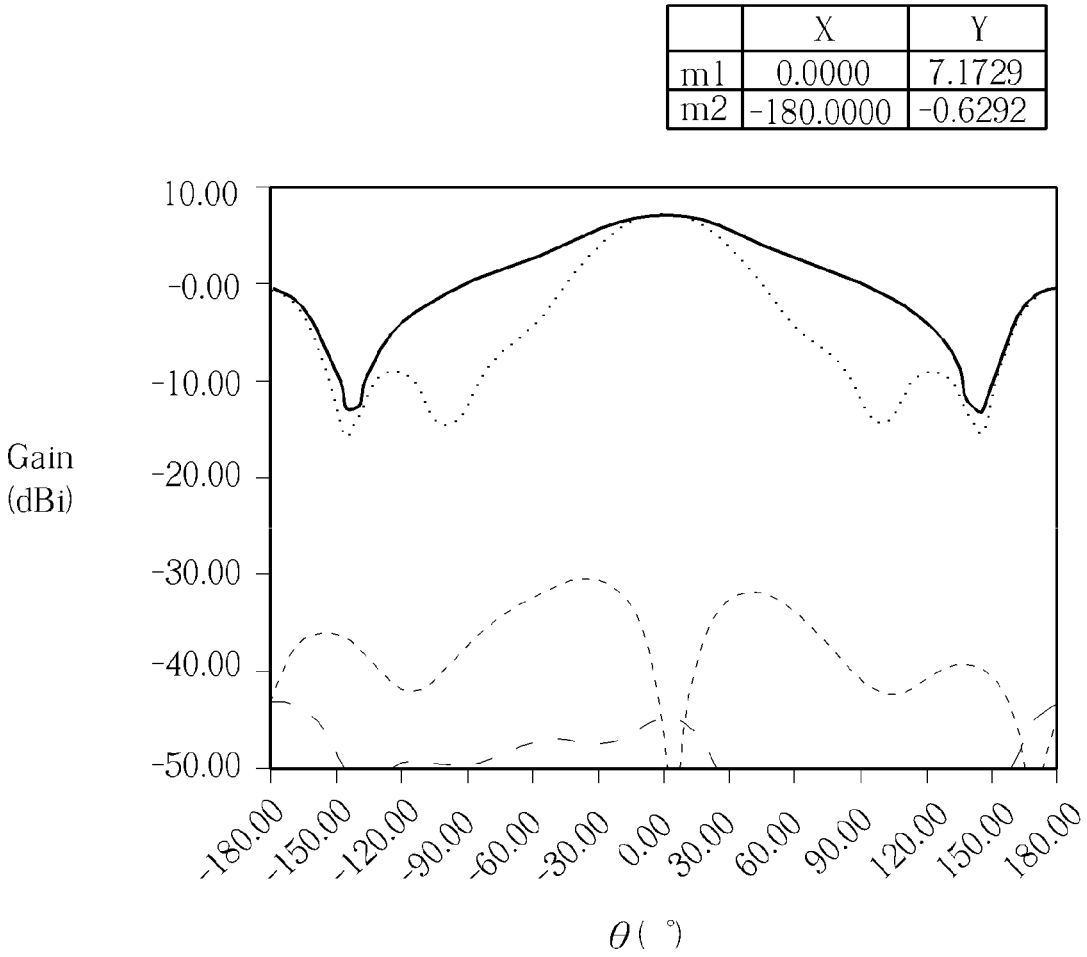
FIG. 9B is a schematic diagram illustrating antenna pattern characteristic simulation results of the dipole antenna shown in FIG. 6 at 826.5 MHz.
Figure 10A:
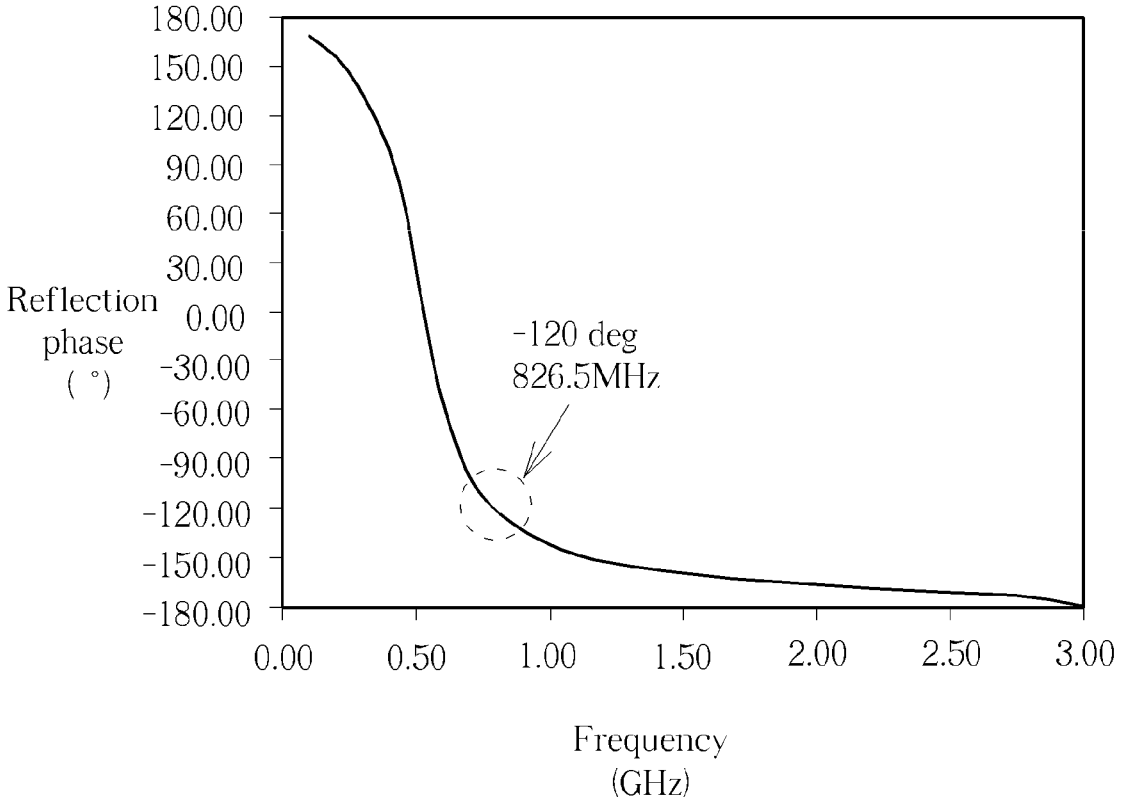
FIG. 10A is a schematic diagram illustrating the curve representing the relationship between frequencies and reflection phases of the magnetic conductor reflector shown in FIG. 6.
Figure 10B:
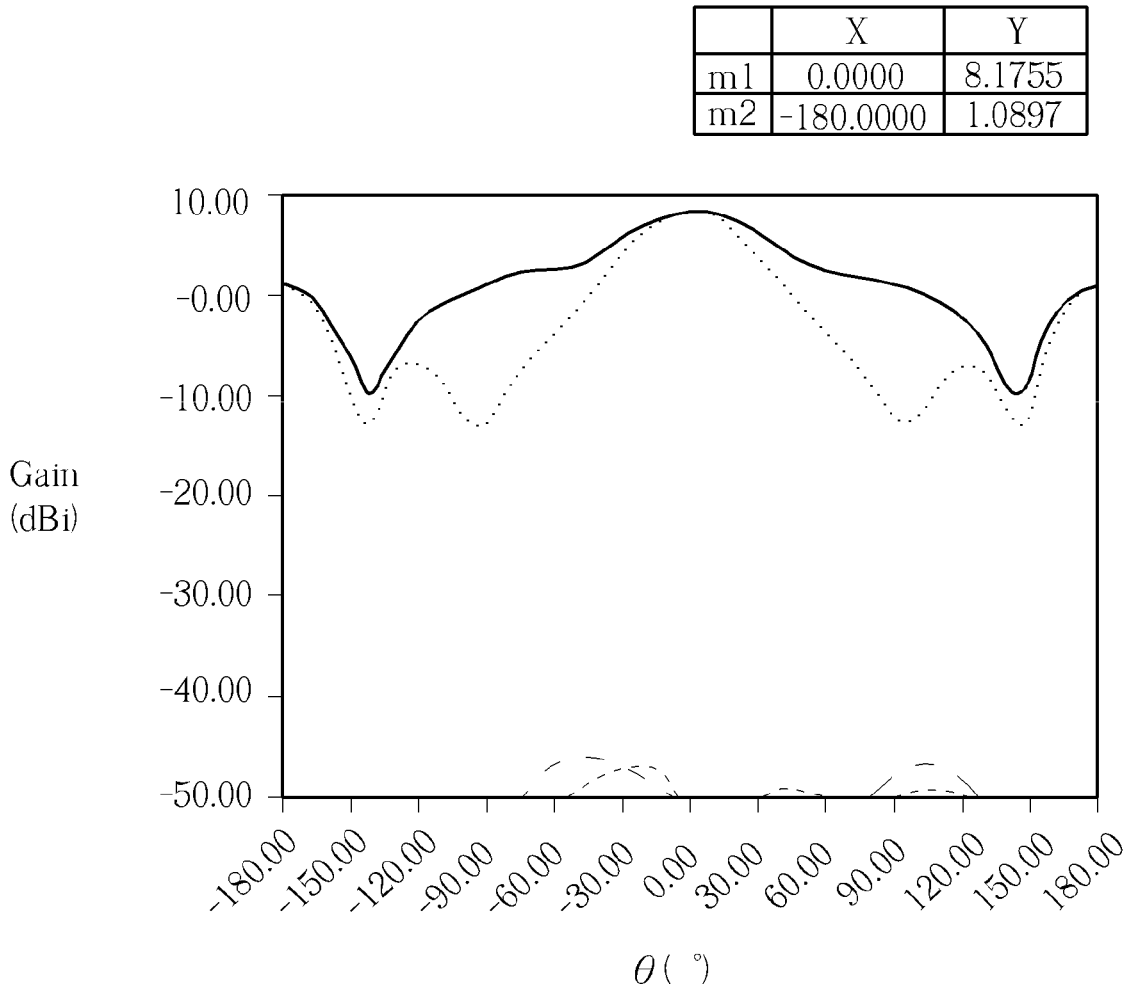
FIG. 10B is a schematic diagram illustrating antenna pattern characteristic simulation results of the dipole antenna shown in FIG. 6 at 826.5 MHz

In such a situation, if the thickness of the magnetic conductor reflector 900 is set to be 11.1 mm, a distance H between the magnetic conductor reflector 900 and the radiation portion 910 is set to be 60.5 mm, then, FIG. 7A is a schematic diagram illustrating the curve representing the relationship between frequencies and reflection phases of the magnetic conductor reflector 900, and FIG. 7B is a schematic diagram illustrating antenna pattern characteristic simulation results of the dipole antenna 90 at 826.5 MHz, wherein the reflection phase of the magnetic conductor reflector 900 at 826.5 MHz is 120°. If the thickness of the magnetic conductor reflector 900 is set to be 15.2 mm, the distance H between the magnetic conductor reflector 900 and the radiation portion 910 is set to be 30.1 mm, then, FIG. 8A is a schematic diagram illustrating the curve representing the relationship between frequencies and reflection phases of the magnetic conductor reflector 900, and FIG. 8B is a schematic diagram illustrating antenna pattern characteristic simulation results of the dipole antenna 90 at 826.5 MHz, wherein the reflection phase of the magnetic conductor reflector 900 at 826.5 MHz is 60°. If the thickness of the magnetic conductor reflector 900 is set to be 22.6 mm, the distance H between the magnetic conductor reflector 900 and the radiation portion 910 is set to be 151.3 mm, then, FIG. 9A is a schematic diagram illustrating the curve representing the relationship between frequencies and reflection phases of the magnetic conductor reflector 900, and FIG. 9B is a schematic diagram illustrating antenna pattern characteristic simulation results of the dipole antenna 90 at 826.5 MHz, wherein the reflection phase of the magnetic conductor reflector 900 at 826.5 MHz is −60°. If the thickness of the magnetic conductor reflector 900 is set to be 45 mm, the distance H between the magnetic conductor reflector 900 and the radiation portion 910 is set to be 120.0 mm, then, FIG. 10A is a schematic diagram illustrating the curve representing the relationship between frequencies and reflection phases of the magnetic conductor reflector 900, and FIG. 10B is a schematic diagram illustrating antenna pattern characteristic simulation results of the dipole antenna 90 at 826.5 MHz, wherein the reflection phase of the magnetic conductor reflector 900 at 826.5 MHz is −120°. As shown in FIGS. 7A to 10B, the reflected radio signals bounced back from the magnetic conductor reflector 900 at 826.5 MHz and the incident radio signals at 826.5 MHz, which are transmitted and received by the radiation portion 910, can add up in phase in space.

TABLE 4

| reflection phase | distance between the magnetic conductor reflector and the radiation portion |
|---|---|
| 180° | 90.7 mm |
| 120° | 60.5 mm |
| 60° | 30.2 mm |
| 0° | 0 mm |
| −60° | 151.2 mm |
| −120° | 120.9 mm |
| −180° | 90.7 mm |

Figure 11:
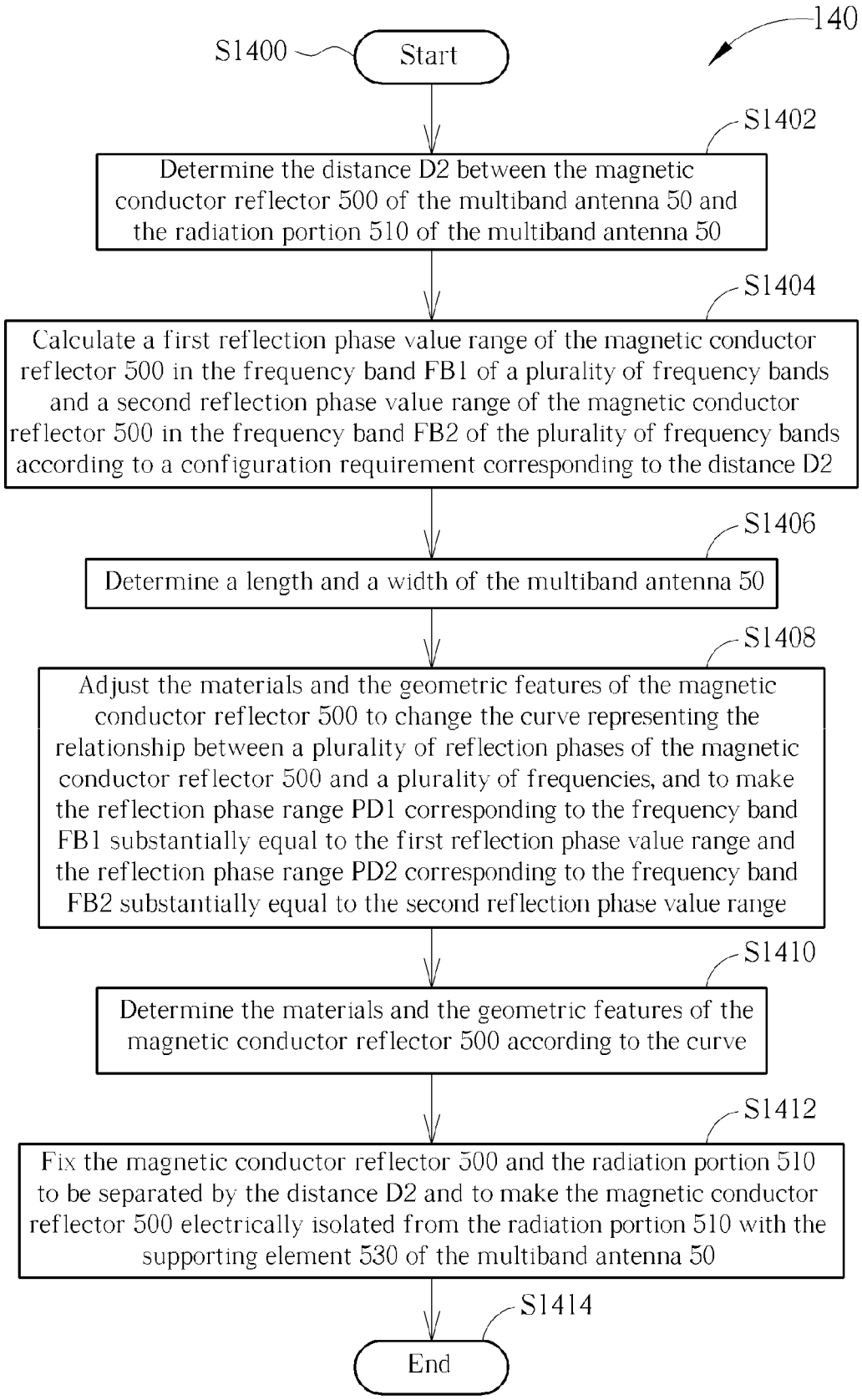
FIG. 11 is a flow schematic diagram illustrating a multiband antenna configuration method adapted to the multiband antenna shown in FIG. 1A according to an embodiment of the present invention.

The multiband antenna configuration method may be modified according to different system requirements or design considerations. For example, FIG. 11 is a flow schematic diagram illustrating the multiband antenna configuration method 11 adapted to the multiband antenna 50 according to an embodiment of the present invention. The multiband antenna configuration method 11 includes the following steps:

Step S1400: Start.

Step S1402: Determine the distance D2 between the magnetic conductor reflector 500 of the multiband antenna 50 and the radiation portion 510 of the multiband antenna 50.

Step S1404: Calculate a first reflection phase value range of the magnetic conductor reflector 500 in the frequency band FB1 of a plurality of frequency bands and a second reflection phase value range of the magnetic conductor reflector 500 in the frequency band FB2 of the plurality of frequency bands according to a configuration requirement corresponding to the distance D2.

Step S1406: Determine a length and a width of the multiband antenna 50.

Step S1408: Adjust the materials and the geometric features of the magnetic conductor reflector 500 to change the curve representing the relationship between a plurality of reflection phases of the magnetic conductor reflector 500 and a plurality of frequencies, and to make the reflection phase range PD1 corresponding to the frequency band FB1 substantially equal to the first reflection phase value range and the reflection phase range PD2 corresponding to the frequency band FB2 substantially equal to the second reflection phase value range.

Step S1410: Determine the materials and the geometric features of the magnetic conductor reflector 500 according to the curve.

Step S1412: Fix the magnetic conductor reflector 500 and the radiation portion 510 to be separated by the distance D2 and to make the magnetic conductor reflector 500 electrically isolated from the radiation portion 510 with the supporting element 530 of the multiband antenna 50.

Step S1414: End.

As set forth above, although the multiband antenna configuration method 140 is substantially similar to the multiband antenna configuration method 60 shown in FIG. 3, it is the first reflection phase value range of the frequency band FB1 and the second reflection phase value range of the frequency band FB2 that are calculated in the multiband antenna configuration method 140. Moreover, after the curve representing the relationship between frequencies and reflection phases is properly adjusted, the reflection phase range PD1 corresponding to the frequency band FB1 equals the first reflection phase value range, and the reflection phase range PD2 corresponding to the frequency band FB2 equals the second reflection phase value range. The curve representing the relationship between frequencies and reflection phases is directly adjusted in the multiband antenna configuration method 140 to make the reflected radio signals bounced back from the magnetic conductor reflector 500 in the frequency bands FB1, FB2 respectively in phase with the incident radio signals in the frequency bands FB1, FB2, which are transmitted and received by the radiation portion 510, in space, thereby achieving constructive interference.

To sum up, by properly designing the distances between the radiation portions and the magnetic conductor reflector and the materials and the geometric features of the magnetic conductor reflector, the reflected radio signals bounced back from the magnetic conductor reflector in a plurality of frequency bands and the incident radio signals in the plurality of frequency bands, which are transmitted and received by the radiation portions, add up in phase in space to increase the gain of the multiband antenna. In addition, because the slope of the curve representing the relationship between frequencies and reflection phases is rather flat when the reflection phase is in a range of 0° to 180° or in a range of −180° to 0°, the bandwidth of the multiband antenna is wider. The distances between the radiation portions and the magnetic conductor reflector are substantially in a range of zero to a quarter of the wavelengths of the radio signals, and the length and the width of the multiband antenna can be determined arbitrarily; thus the size of the multiband antenna can be minimized. Last but not least, the mutually perpendicular radiation portions can be Bishop's Hat dipole antennas, such that bandwidth increases, space is utilized effectively, and the overlap between the radiation portions is smaller to enhance isolation of different polarizations.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A multiband antenna configuration method, adapted to a multiband antenna for transmitting and receiving radio signals in a plurality of frequency bands, the multiband antenna configuration method comprising:

determining a distance between a magnetic conductor reflector of the multiband antenna and a first radiation portion of the multiband antenna, wherein the magnetic conductor reflector is configured to reflect the radio signals in order to increase gain of the multiband antenna;

calculating a first reflection phase value of the magnetic conductor reflector at a first center frequency of a first frequency band in the plurality of frequency bands and a second reflection phase value of the magnetic conductor reflector at a second center frequency of a second frequency band in the plurality of frequency bands according to a configuration requirement corresponding to the distance, wherein the configuration requirement is utilized to make the radio signals and reflection of the radio signals interfere constructively in at least one position in space;

determining a length and a width of the multiband antenna;

adjusting a material and a geometric feature of the magnetic conductor reflector to change a curve representing relationship between a plurality of reflection phases of the magnetic conductor reflector and a plurality of frequencies, and to make a first reflection phase corresponding to the first center frequency equal to the first reflection phase value and a second reflection phase corresponding to the second center frequency equal to the second reflection phase value; and determining the material and the geometric feature of the magnetic conductor reflector according to the curve representing the relationship between the plurality of reflection phases of the magnetic conductor reflector and the plurality of frequencies.

2. The multiband antenna configuration method of claim 1, wherein the first reflection phase value is in a range of 0 degrees to 180 degrees, and the second reflection phase value is in a range of −180 degrees to 0 degrees.

3. The multiband antenna configuration method of claim 1, wherein the geometric feature is a length of the magnetic conductor reflector, a width of the magnetic conductor reflector, a height of the magnetic conductor reflector, a length of one of a plurality of reflection units of the magnetic conductor reflector, a width of one of the plurality of reflection units of the magnetic conductor reflector, or a radius of one of a plurality of vias of the magnetic conductor reflector.

4. The multiband antenna configuration method of claim 1, wherein the distance is less than ¼ of wavelength of the radio signals in the plurality of frequency bands.

5. The multiband antenna configuration method of claim 1, wherein the multiband antenna further comprises a second radiation portion disposed corresponding to the first radiation portion, and a centerline of the first radiation portion is substantially perpendicular to a centerline of the second radiation portion to transmit and receive radio signals of mutually orthogonal polarizations.

6. The multiband antenna configuration method of claim 1, further comprising fixing the magnetic conductor reflector and the first radiation portion to be separated by the distance and to make the magnetic conductor reflector electrically isolated from the radiation portion with a supporting element of the multiband antenna.

7. The multiband antenna configuration method of claim 4, wherein according to the configuration requirement, the first reflection phase value $\theta 1$ satisfies $\theta 1=4\pi D/\lambda 1$, and the second reflection phase value $\theta 2$ satisfies $\theta 2=4\pi D/\lambda 2-2\pi$, such that a first phase difference between the radio signals at the first center frequency and reflection of the radio signals at the at least one position is zero, and a second phase difference between the radio signals at the second center frequency and reflection of the radio signals at the at least one position is $2\pi$, wherein D denotes the distance, $\lambda 1$ denotes a first wavelength corresponding to the first center frequency, and $\lambda 2$ denotes a second wavelength corresponding to the second center frequency.

8. A multiband antenna, configured to transmit and receive radio signals in a plurality of frequency bands, comprising:

a magnetic conductor reflector, configured to reflect the radio signals in order to increase gain of the multiband antenna; and a first radiation portion, disposed on the magnetic conductor reflector;

wherein the magnetic conductor reflector and the first radiation portion are disposed according to a multiband antenna configuration method, the multiband antenna configuration method comprises determining a distance between the magnetic conductor reflector and the first radiation portion; calculating a first reflection phase value of the magnetic conductor reflector at a first center frequency of a first frequency band in the plurality of frequency bands and a second reflection phase value of the magnetic conductor reflector at a second center frequency of a second frequency band in the plurality of frequency bands according to a configuration requirement corresponding to the distance, wherein the configuration requirement is utilized to make the radio signals and reflection of the radio signals interfere constructively in at least one position in space; determining a length and a width of the multiband antenna; adjusting a material and a geometric feature of the magnetic conductor reflector to change a curve representing relationship between a plurality of reflection phases of the magnetic conductor reflector and a plurality of frequencies, and to make a first reflection phase corresponding to the first center frequency equal to the first reflection phase value and a second reflection phase corresponding to the second center frequency equal to the second reflection phase value; and determining the material and the geometric feature of the magnetic conductor reflector according to the curve representing the relationship between the plurality of reflection phases of the magnetic conductor reflector and the plurality of frequencies.

9. The multiband antenna of claim 8, wherein the first reflection phase value is in a range of 0 degrees to 180 degrees, and the second reflection phase value is in a range of −180 degrees to 0 degrees.

10. The multiband antenna of claim 8, wherein the geometric feature is a length of the magnetic conductor reflector, a width of the magnetic conductor reflector, a height of the magnetic conductor reflector, a length of one of a plurality of reflection units of the magnetic conductor reflector, a width of one of the plurality of reflection units of the magnetic conductor reflector, or a radius of one of a plurality of vias of the magnetic conductor reflector.

11. The multiband antenna of claim 8, wherein the distance is less than ¼ of wavelength of the radio signals in the plurality of frequency bands.

12. The multiband antenna of claim 8, further comprising a second radiation portion disposed corresponding to the first radiation portion, wherein a centerline of the first radiation portion is substantially perpendicular to a centerline of the second radiation portion to transmit and receive radio signals of mutually orthogonal polarizations.

13. The multiband antenna of claim 8, further comprising a supporting element, configured to fix the magnetic conductor reflector and the first radiation portion to be separated by the distance and to make the magnetic conductor reflector electrically isolated from the radiation portion.

14. The multiband antenna of claim 11, wherein according to the configuration requirement, the first reflection phase value $\theta 1$ satisfies $\theta 1=4\pi D/\lambda 1$, and the second reflection phase value $\theta 2$ satisfies $\theta 2=4\pi D/\lambda 2-2\pi$, such that a first phase difference between the radio signals at the first center frequency and reflection of the radio signals at the at least one position is zero, and a second phase difference between the radio signals at the second center frequency and reflection of the radio signals at the at least one position is $2\pi$, wherein D denotes the distance, $\lambda 1$ denotes a first wavelength corresponding to the first center frequency, and $\lambda 2$ denotes a second wavelength corresponding to the second center frequency.

* * * * *